US006961704B1

(12) United States Patent
Phillips et al.

(10) Patent No.: US 6,961,704 B1
(45) Date of Patent: Nov. 1, 2005

(54) LINGUISTIC PROSODIC MODEL-BASED TEXT TO SPEECH

(75) Inventors: Michael S. Phillips, Belmont, MA (US); Daniel S. Faulkner, Arlington, MA (US); Marek A. Przezdzieci, Ithaca, NY (US)

(73) Assignee: Speechworks International, Inc., Boston, MA (US)

( * ) Notice: Subject to any disclaimer, the term of this patent is extended or adjusted under 35 U.S.C. 154(b) by 166 days.

(21) Appl. No.: 10/355,296

(22) Filed: Jan. 31, 2003

(51) Int. Cl.[7] ..... G10L 13/08
(52) U.S. Cl. ..... 704/268; 704/267
(58) Field of Search ..... 704/268, 267, 704/260, 258

(56) References Cited

U.S. PATENT DOCUMENTS 6,173,263 B1 * 1/2001 Conkie ..... 704/260
6,260,016 B1 * 7/2001 Holm et al. ..... 704/260
6,366,883 B1 * 4/2002 Campbell et al. ..... 704/260
6,665,641 B1 * 12/2003 Coorman et al. ..... 704/260

FOREIGN PATENT DOCUMENTS

WO WO 00/30069 * 5/2000 ..... 704/260

OTHER PUBLICATIONS

Balestri, Marcello, Alberto Pacchiotti, Silvia Quazza, Pier Luigi Salza, and Stefano Sandri, "Choose the Best to Modify the Least: A New Generation Concatenative Synthesis System," Proc. Eurospeech '99, Budapest, Sep. 5–9, 1999, vol. 5, pp. 2291–2294.*

Rutten, Peter, Geert Coorman, Justin Fackrell, and Bert Van Coile, "Issues in Corpus Based Speech Synthesis," Proc. IEE Symposium on State–of–the–Art in Speech Synthesis, Savoy Place, London, 2000, pp. 16/1–16/7.*

Wightman, Colin W. and Mari Ostendorf, "Automatic labeling of Prosodic Patterns," IEEE Trans. on Speech and Audio Proc., Oct. 1994, vol. 2, No. 4, pp. 469–481.*

Conkie, Alistair, "Robust Unit Selection System For Speech Synthesis," *AT&T Labs—Research*, http://www.research.at-t.com/projects.

Beutnagel, M., Conkie, A., Schroeter, J., Stylianou, Y., and Syrdal, A., "The AT&T Next–Gen TTS System," *AT&T Labs—Research*, http://www.research.att.com/projects.

Hunt, Andrew J. and Black, Alan W., "Unit Selection In A Concatenative Speech Synthesis System Using A Large Speech Database," *Proc. ICASSP–96*, May 7–10.

* cited by examiner

*Primary Examiner*—Richemond Dorvil
*Assistant Examiner*—Donald L. Storm
(74) *Attorney, Agent, or Firm*—Pillsbury Winthrop Shaw Pittman LLP

(57) ABSTRACT

An arrangement is provided for text to speech processing based on linguistic prosodic models. Linguistic prosodic models are established to characterize different linguistic prosodic characteristics. When an input text is received, a target unit sequence is generated with a linguistic target that annotates target units in the target unit sequence with a plurality of linguistic prosodic characteristics so that speech synthesized in accordance with the target unit sequence and the linguistic target has certain desired prosodic properties. A unit sequence is selected in accordance with the target unit sequence and the linguistic target based on joint cost information evaluated using established linguistic prosodic models. The selected unit sequence is used to produce synthesized speech corresponding to the input text.

47 Claims, 13 Drawing Sheets

Training Data = { (phonetic unit, linguistic prosody label, acoustic feature set) }

LINGUISTIC PROSODIC MODEL-BASED TEXT TO SPEECH

BACKGROUND

Generating speech with desirable properties has been a focus in text to speech. Efforts have been made to produce synthesized speech with a more natural sound. One approach to generating natural sounding synthesized speech is to select phonetic units from a large unit database to produce a realization of a target unit sequence which was predicted based on the input text. To specify a desired sound, the predicted target unit sequence may be annotated with prosodic patterns and/or target that represent linguistic prosodic characteristics. FIG. 1 (Prior Art) illustrates a conventional framework 100 for unit-selection based text to speech processing. The conventional framework 100 typically comprises a text to speech (TTS) front end 110, a unit selection mechanism 160, a unit database 170, and a speech synthesis mechanism 180.

The TTS front end 110 takes text as input and produces a target unit sequence with an acoustic target as its output. The target unit sequence is predicted according to the text input. The acoustic target annotates the target units in the target unit sequence with acoustic prosodic characteristics. The acoustic prosodic characteristics may be generated with the goal that the synthesized speech using units selected according to the annotated target unit sequence has some desired speech properties.

To generate the target unit sequence with an acoustic target, the TTS front end 110 may process the text at different stages. The TTS front end 110 may typically include a text normalization mechanism 120, a linguistic analysis mechanism 130, a linguistic target generation mechanism 140, and an acoustic target generation mechanism 150. Input text with any abbreviated words is first converted into normalized text. This is achieved by the text normalization mechanism 120. During such processing, an abbreviated word such as "Corp." may be converted into a normalized word such as "corporation".

The linguistic analysis mechanism 130 analyzes the normalized text and produces a sequence of phonetic units predicted based on the words contained in the normalized text. For instance, for the word "pot", the linguistic analysis mechanism 130 may produce three phonemes arranged in the order of /p/, /a/, and /t/. The sequence of units produced at this stage specifies the necessary phonetics to produce the synthesized speech.

To produce desired prosodic properties, the linguistic target generation mechanism 140 annotates the units with desired linguistic prosodic characteristics. For example, if the word "pot" is to be stressed, the vowel in "pot" (i.e., phoneme /a/) may be annotated as "stressed". If a word is the last word of a phrase (it is often lengthened), so all appropriate phonetic units within this word may be annotated as "end of phrase". Such linguistic annotations specify a relevant linguistic prosodic context, and therefore influence what the synthesized speech sounds like.

Linguistic annotation is at a symbolic level. To realize the intended speech effect, the conventional framework 100 maps such symbolic annotations to corresponding acoustic annotations. The acoustic annotations specify how to realize the intended speech effect. For each linguistic annotation at a symbolic level, the acoustic target generation mechanism 150 translates the linguistic annotation into one or more acoustic annotations. For instance, for a phoneme /a/ annotated with a linguistic prosodic characteristic "stressed", three acoustic annotations, associated individually with acoustic features pitch, energy, and duration, may be generated. The acoustic annotations are generated in such a way that by complying with the annotated acoustic features, the synthesized speech will have the intended linguistic prosodic characteristics. For example, using the acoustic annotations in terms of pitch, energy, and duration features translated from a linguistic annotation "stressed" in synthesis, a stressed vowel /a/ may be produced.

In the conventional framework 100, the unit selection mechanism 160 takes the target unit sequence annotated with acoustic target and selects units from the unit database 170 according to the acoustically annotated target unit sequence. That is, the selected units not only satisfy what is required according to the target unit sequence but also possess, to the greatest extent possible, the acoustic properties specified by the acoustic target. The output of the unit selection mechanism 160 is a selected unit sequence which is then fed to the speech synthesis mechanism 180 to synthesize the speech.

BRIEF DESCRIPTION OF THE DRAWINGS

The inventions claimed and/or described herein are further described in terms of exemplary embodiments. These exemplary embodiments are described in detail with reference to the drawings. These embodiments are non-limiting exemplary embodiments, in which like reference numerals represent similar parts throughout the several views of the drawings, and wherein:

FIG. 3(*b*) depicts a diagram of a labeled training data generation mechanism, according to embodiments of the present invention;

FIG. 3(*c*) illustrates exemplary distributions of some linguistic prosodic characteristics in a two dimensional acoustic feature space;

FIG. 3(*d*) illustrated an exemplary construct of a linguistic prosodic model in the form of a regress tree, according to embodiments of the present invention;

FIG. 5(*b*) depicts the internal high level functional block diagram of a cost estimation mechanism, according to embodiments of the present invention;

DETAILED DESCRIPTION

The processing described below may be performed by a properly programmed general-purpose computer along or in connection with a special purpose computer. Such processing may be performed by a single platform or by a distributed processing platform. In addition, such processing and functionality can be implemented in the form of special purpose hardware or in the form of software or firmware being run by a general-purpose or network processor. Data handled in such processing or created as a result of such processing can be stored in any memory as is conventional in the art. By way of example, such data may be stored in a temporary memory, such as in the RAM of a given computer system or subsystem. In addition, or in the alternative, such data may be stored in longer-term storage devices, for example, magnetic disk, rewritable optical disks, and so on. For purposes of the disclosure herein, a computer-readable media may comprise any form of data storage mechanism, including such existing memory technologies as well as hardware or circuit representations of such structures and of such data.

Figure 1:
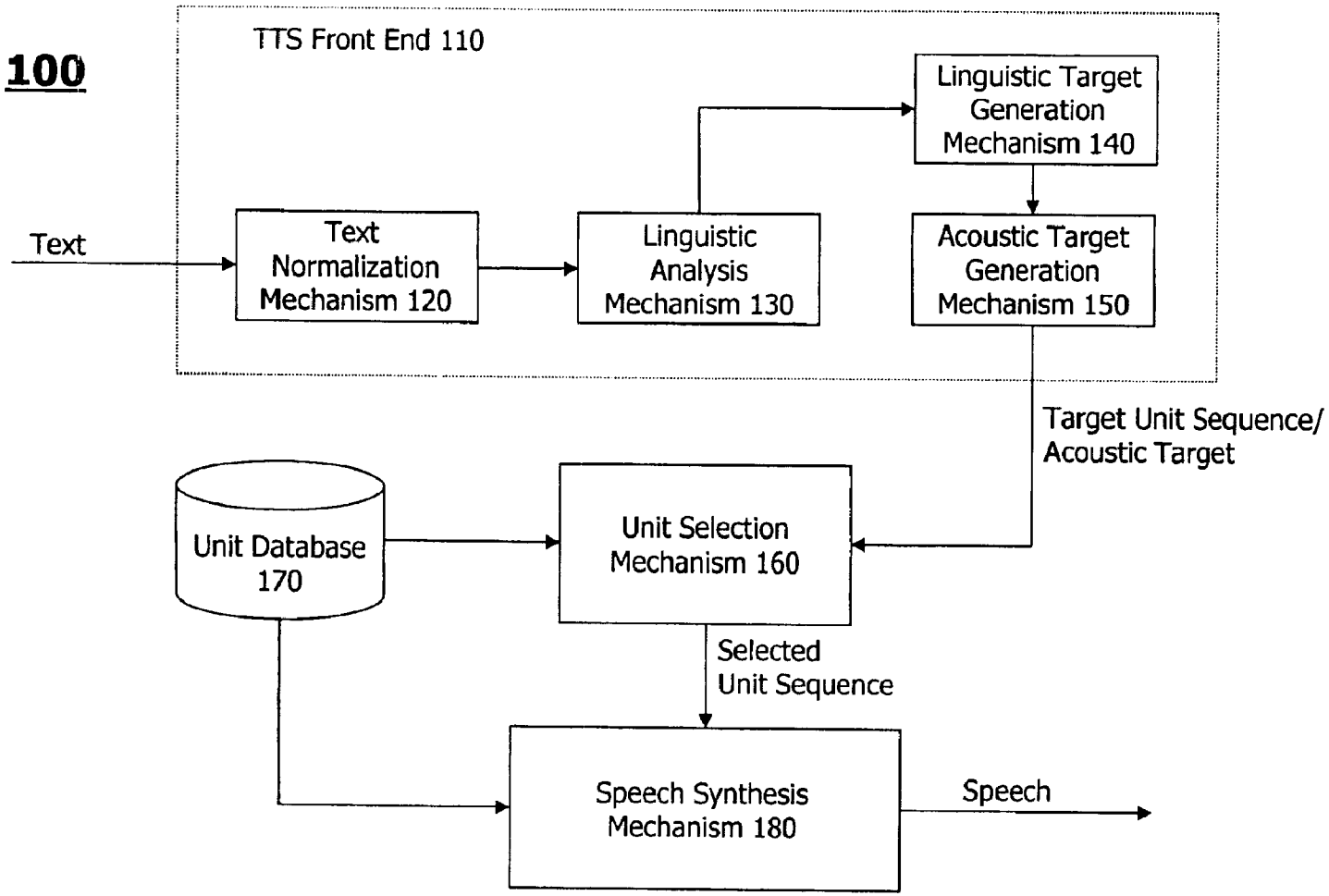
FIG. 1 (Prior Art)
FIG. 1 (Prior Art) describes the framework of conventional unit-selection based text to speech processing where phonetic units are selected from a unit database in accordance with a target unit sequence annotated with acoustic targets.
Figure 2:
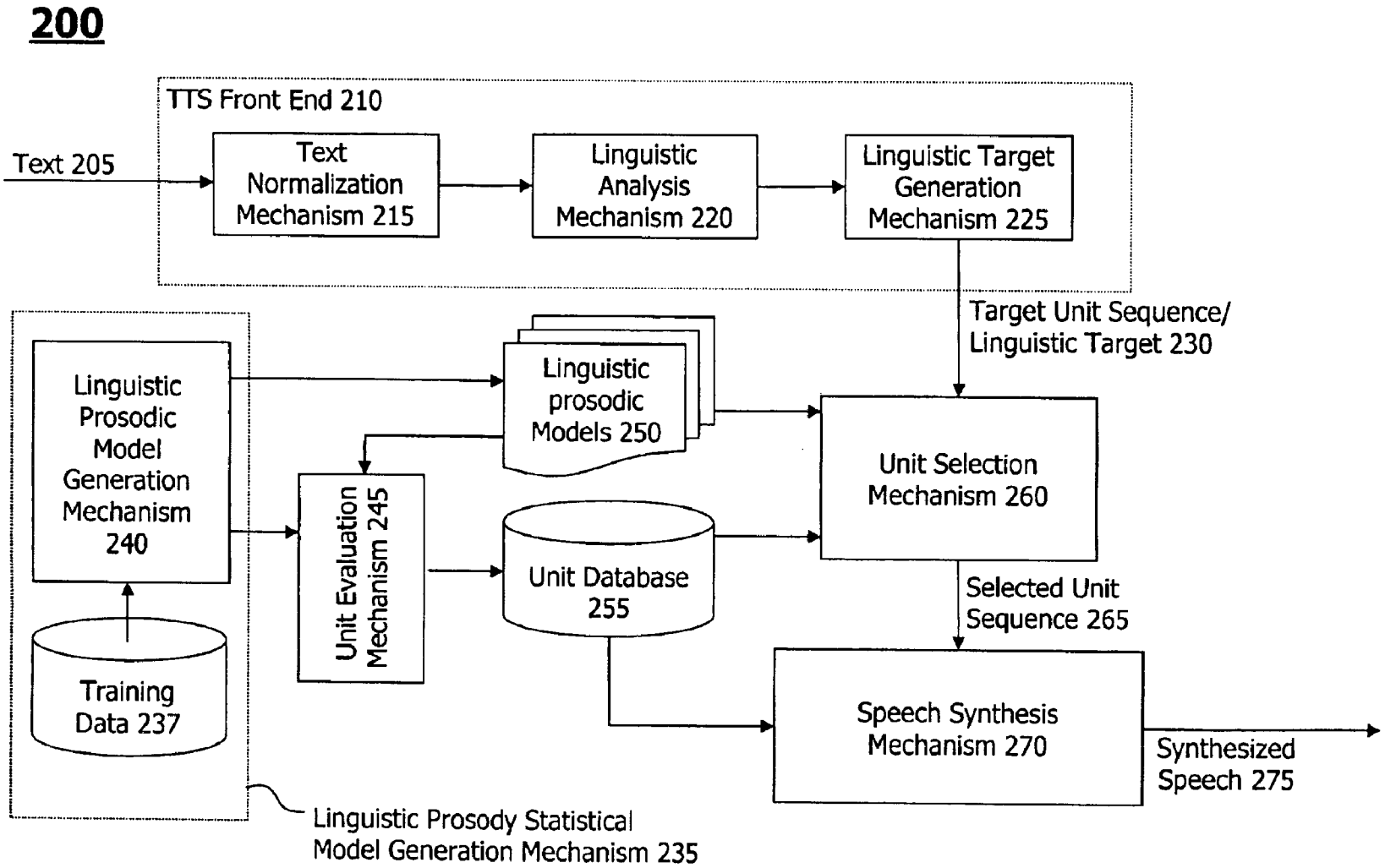
FIG. 2 depicts a framework of present inventive unit-selection based text to speech where phonetic units with respect to a target unit sequence with a linguistic target are selected using linguistic prosodic models, according to embodiments of the present invention.
Figure 3A:
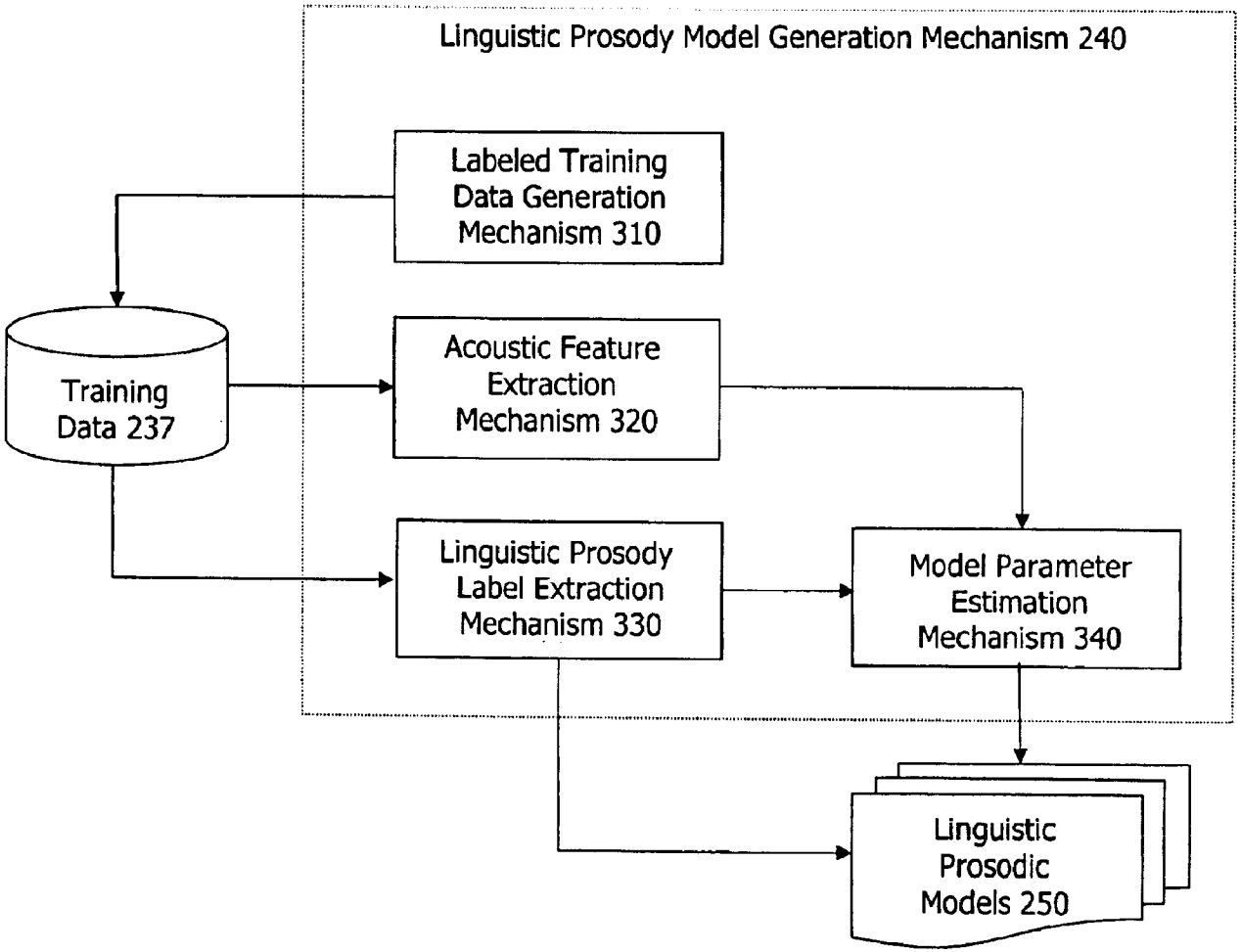
FIG. 3(*a*) depicts the internal high level functional block diagram of a linguistic prosodic model generation mechanism, according to embodiments of the present invention.
Figure 3B:
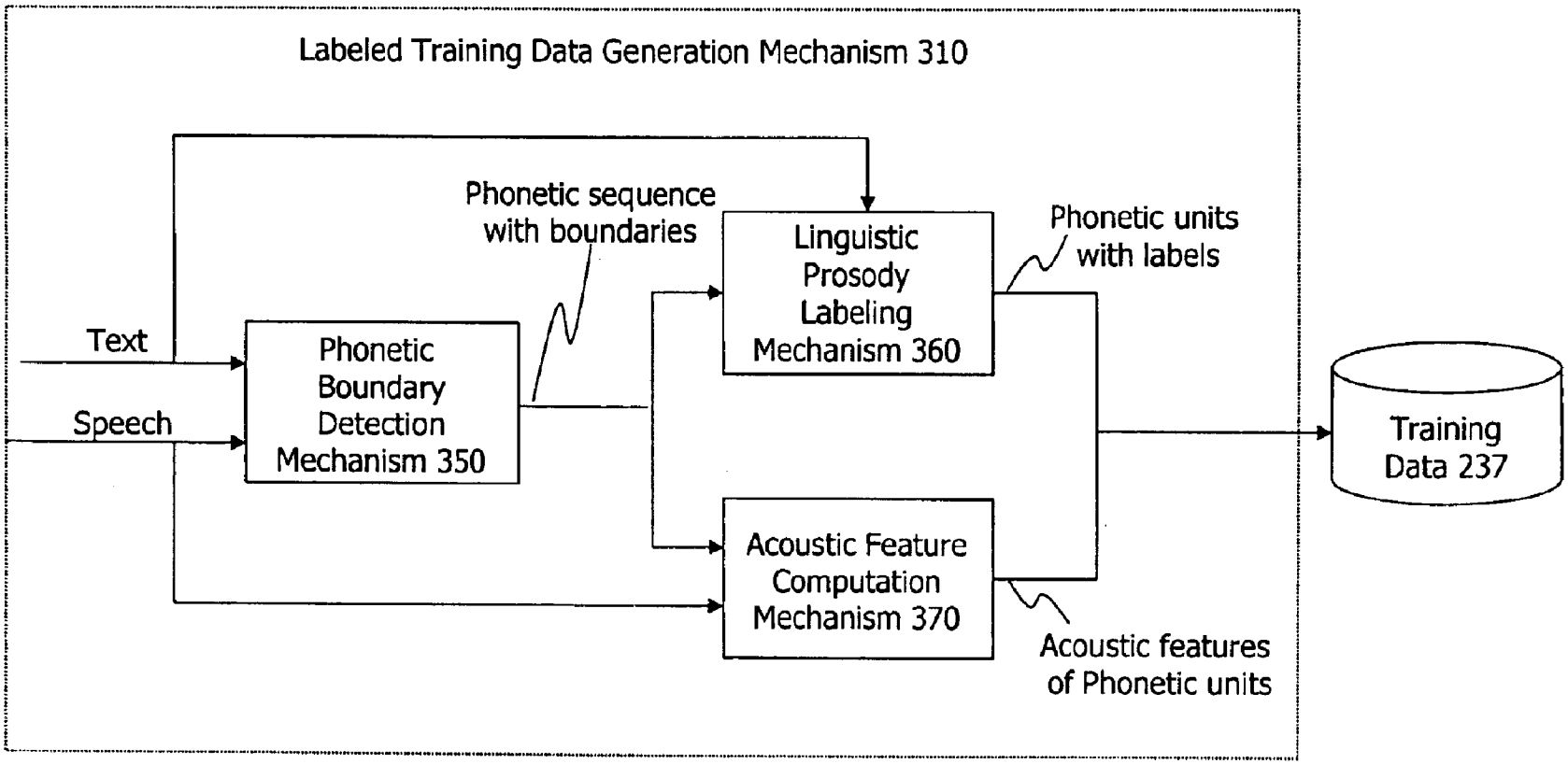
Figure 3C:
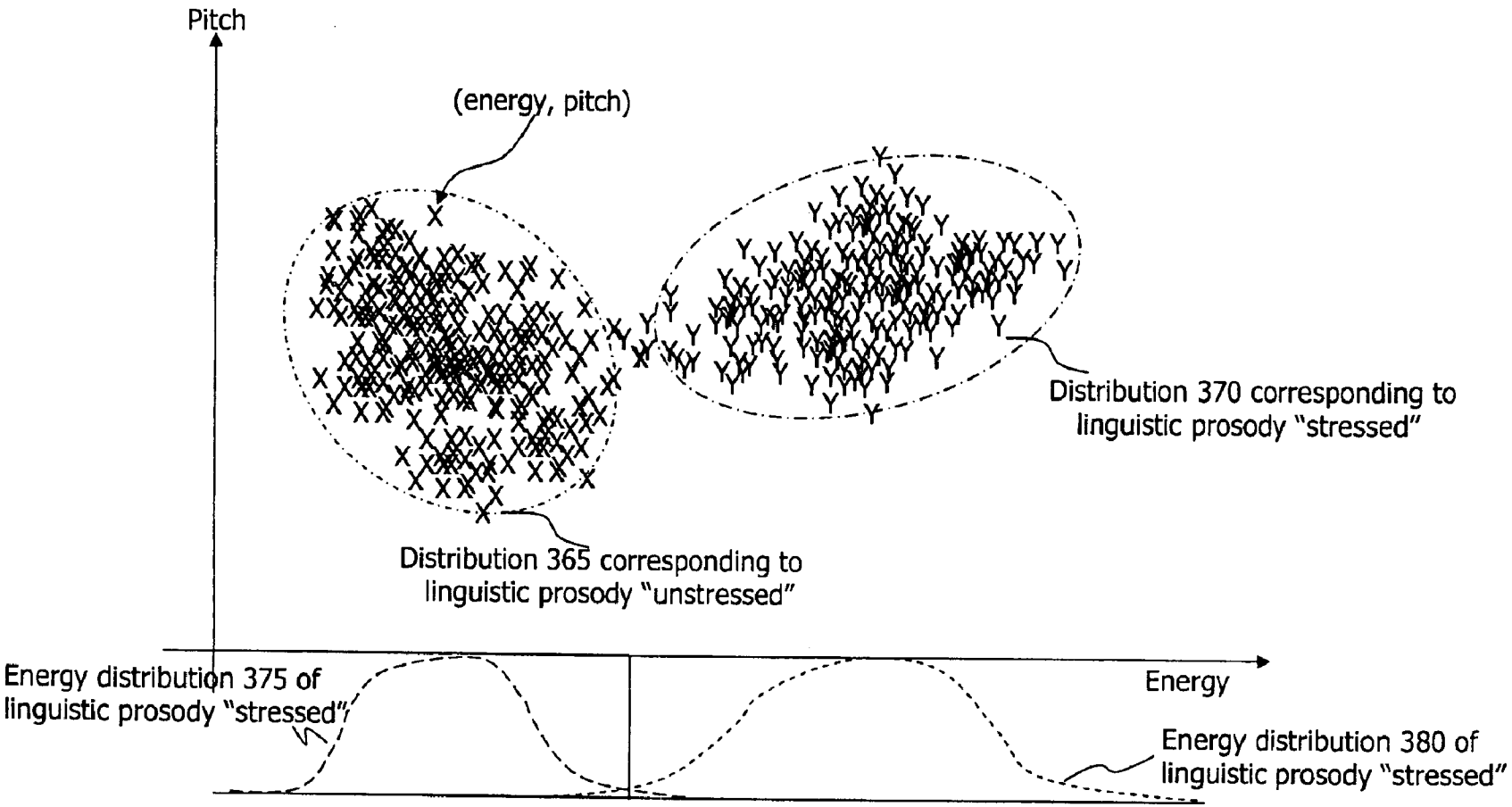
Figure 3D:
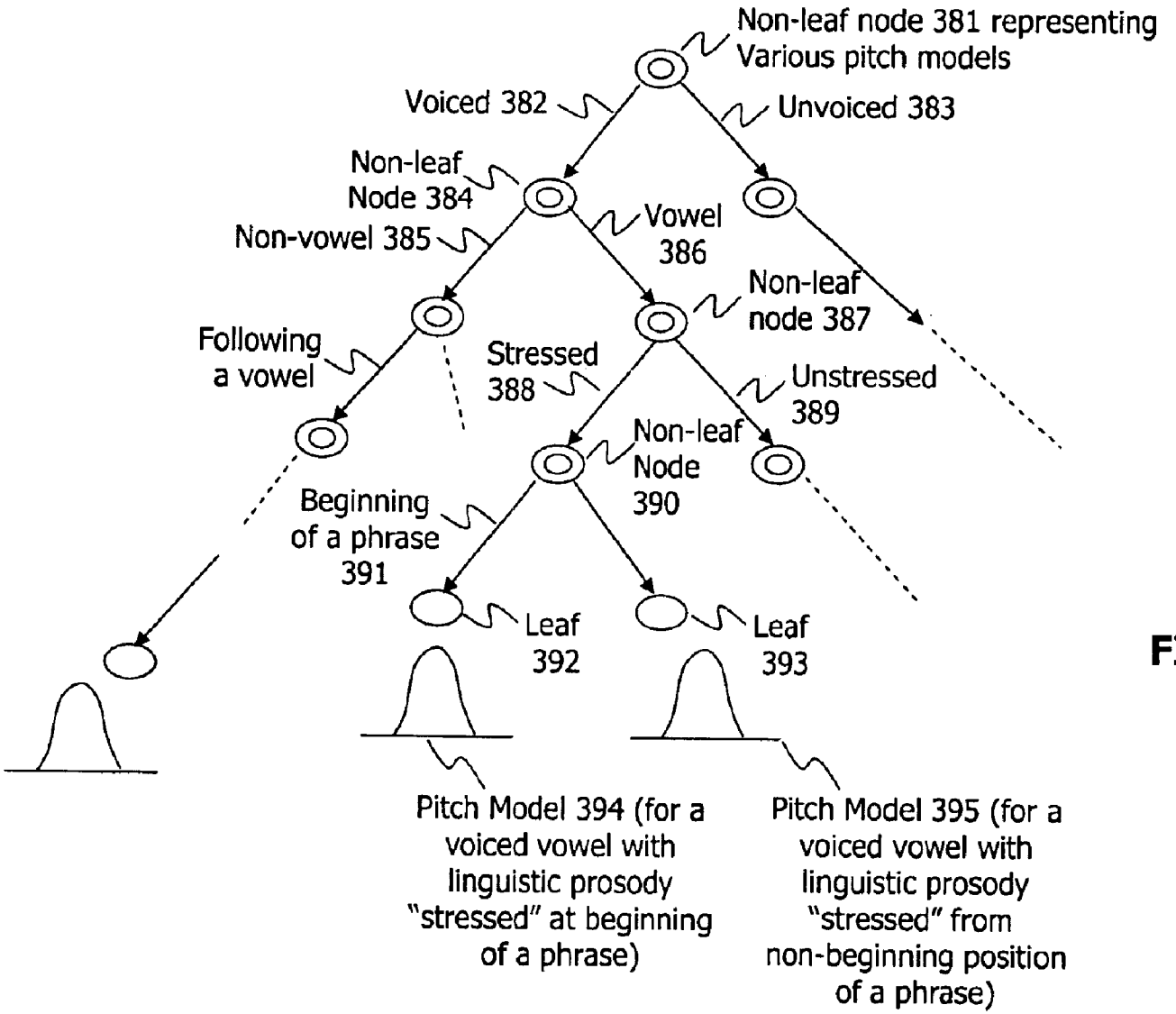

FIG. 2 depicts a framework 200 of present inventive unit-selection based text to speech processing where phonetic units with respect to a target unit sequence with linguistic targets are selected using linguistic prosodic models, according to embodiments of the present invention. The framework 200 comprises a text to speech (TTS) front end 210, a linguistic prosodic model generation mechanism 240, a storage for a plurality of linguistic prosodic models 250 derived to represent linguistic prosodic characteristics, a unit database 255, a unit selection mechanism 260, and a speech synthesis mechanism 270. The framework 200 may also optionally include a unit evaluation mechanism 245. The role of each mechanism depicted in the framework 200 is described below.

The TTS front end 210 takes a text 205 as input and generates a target unit sequence with linguistic target 230 as its output. The target unit sequence 230 specifies a plurality of phonetic units arranged in an order consistent with the input text 205. For example, the word "pot" (input text) may correspond to a target unit sequence that includes three phonemes arranged in the order of /p/, /a/, and /t/. The linguistic target may annotate the phonetic units in the target unit sequence to specify desired linguistic prosodic characteristics associated with the phonetic units. For instance, the beginning position of the phrase "cats and dogs" in an input text may be annotated as "stressed". Such linguistic annotation is at a symbolic level and focuses on the desired linguistic prosodic characteristics in the synthesized speech.

Taking the target unit sequence with linguistic target 230 as input, the unit selection mechanism 260 chooses phonetic units from the unit database 255 in such a way that the selected units, when used in synthesizing speech, yields the best performance in terms of satisfying the desired speech quality specified by the target unit sequence/linguistic target 230. To do so, the unit selection mechanism 260 determines the appropriateness of selected units using linguistic prosodic models 250 that characterize corresponding linguistic prosodic characteristics. For example, a linguistic prosodic model representing the linguistic prosodic characteristic "stressed" may be established in a feature space defined according to acoustic features such as pitch and energy. Such a model may characterize what constitutes the linguistic prosodic characteristic "stressed" in terms of these acoustic features.

A linguistic prosodic model can be used to evaluate whether a particular phonetic unit possesses the modeled linguistic prosodic characteristics. For example, given some acoustic features such as pitch and energy associated with a unit, one may compute a probability based on a model generated to characterize a linguistic prosodic characteristic "stressed" to assess how likely the unit will produce a "stressed" sound. If the desired linguistic prosodic characteristic is "stressed", a unit that has a higher probability has a better chance to be selected than a unit that has a lower probability. The probability of a unit is a score relating to generating a desired sound using the unit. The higher the probability (i.e., the higher the score), the closer the generated sound is to the desired sound. Equivalently, a cost can also be used for the same purpose. In this case, the lower the cost, the closer the generated sound is to the desired sound. Such a cost may be computed as a distance in some feature space between a desired sound and the sound achieved using a unit. In the following descriptions, some discussions are presented using the term cost (lower is better) and some using the term score (higher is better).

The linguistic prosodic model generation mechanism 240 facilitates the process of establishing linguistic prosodic models for various linguistic prosodic characteristics. The linguistics prosodic model generation mechanism 240 estimates linguistic prosodic models of different linguistic prosodic characteristics based on labeled training data 237. Details about how to establish linguistic prosodic models are discussed with reference to FIGS. 3 and 7.

The framework 200 may also optionally include a unit evaluation mechanism 245 that may evaluate, off-line, the units in the unit database 255 against the linguistic prosodic models 250. For instance, each unit in the unit database 255 may be assessed with respect to each of the linguistic prosodic models and a score may be computer based on the assessment. A score derived against a particular linguistic prosodic model may indicate how likely the unit possesses the characteristics of the underlying linguistic prosodic features represented by the model. Each unit may be evaluated in this way against all the linguistic prosodic models which yields a plurality of scores associated with the unit. Such scores may then be used, during text to speech processing, to determine whether a unit possesses some desired prosodic property.

To evaluate how likely a unit possesses the characteristics of a particular linguistic prosodic feature (either off-line or during text to speech processing), acoustic features of the unit may be used. Each unit in the unit database 255 may be presented as a tuple, in which various attributes associated with the unit may be stored. For example, such a tuple may include attributes such as the name of the underlying phonetic unit (e.g., phoneme /a/), context (e.g., adjacent phonetic units), various acoustic feature values such as pitch, duration, energy, and a pointer to its corresponding waveform. If a unit has been scored with respect to different linguistic prosodic models (e.g., performed by the unit evaluation mechanism 245), its tuple may also include such score information. With these attributes made readily available in the unit database 255, the unit selection mechanism 260 may utilize necessary information to evaluate the units in accordance with the target unit sequence and the annotated linguistic prosodic characteristics.

The unit selection mechanism 260 produces a selected unit sequence 265, determined based on the target unit sequence and the linguistic target in such a way that the cost using the selected unit sequence is minimized (or equivalently to maximize a score that reflects the merit of the unit). Details related to the cost used in unit selection and the details related to the unit selection using such Joint cost are described with reference to FIGS. 4, 5, 8, and 9. With the selected unit sequence 265, the speech synthesis mechanism 270 produces synthesized speech 275 corresponding to the input text 205.

TTS Front End Processing

To generate the target unit sequence 230 with a linguistic target based on the input text 205, the TTS front end 210 includes a text normalization mechanism 215, a linguistic analysis mechanism 220, and a linguistic prosody generation mechanism 225. The input text 205 may correspond to a plain text stream or an annotated text stream. The former contains simply text information (i.e., a sentence) based on which speech is to be derived. The latter contains text information as well as annotations specifying certain speech features desired in generating the underlying speech. In the latter case, a user or an application specific pre-processor may add such annotation prior to sending the input text 205 for text to speech processing.

The text normalization mechanism 215 may process the text input 205 and generate normalized or standard text. For example, the text normalization mechanism 215 may convert any words in an abbreviation form in the input text 205 into formal or standard words. One illustration is to convert abbreviation "Corp." into "corporation". Such normalization may be necessary for further linguistic analysis.

The linguistic analysis mechanism 220 may analyze the normalized text from a linguistic point of view and generate a sequence of phonetic units (target unit sequence). The linguistic analysis mechanism 220 may identify, in the normalized input text, different linguistic or grammatical components such as phrases, commas, and syntactic boundaries. A linguistic component may be indicative in terms of what linguistic prosodic characteristics may be desired in generating the corresponding speech. For instance, the beginning of a phrase is often stressed (e.g., in the sentence "It rained cats and dogs.", the word "cat" and the word "dog" may be stressed). It may be common that the sound right before a commas has a longer duration and a pause may be present after a comma (e.g., "If it rains, we will not go hiking"). This pause may be present even if a comma is not (e.g., "If it rains we will not go hiking."). Likewise, there may be no pause even if there is a comma (e.g. "Pass the salt, please."). As another illustration, a pause may be present right before or after a relative clause. For example, the sentence "The house on the hill, which Jack built, is red." has a relative clause "which Jack built". When synthesizing speech from this sentence, a pause may be introduced right before the word "which" and right after the word "built".

The linguistic analysis mechanism 220 may map words in the normalized text into phonetic units. A phonetic unit may correspond to, but is not limited to, a phoneme, a half phoneme (i.e., one half of a phoneme), a di-phone (i.e., last half of a previous phoneme coupled with a first half of an immediately adjacent second phoneme), a bi-phone (i.e., two consecutive phonemes), or a syllable (i.e., a sequence of phonemes comprising a vowel with consonants before and after). Each word may be mapped to one or more phonetic units. Such mapping may be performed based on a dictionary, which links words to sequences of underlying units, or based on rules, or based on a predictive statistical model. For instance, the word "pot" corresponds to a sequence of three phonemes /p/, /a/, and /t/.

Some grammatical components may comprise a sequence of units corresponding to more than one word. In the above mentioned examples, the grammatical component associated with the relative clause "which Jack built" may have a sequence of phonemes corresponding to three words, "which", "Jack" and "built". Grammatical components may also be nested. For instance, within the grammatical component associated with the relative clause "which Jack built", the proper name (i.e., "Jack") may be a different grammatical component nested within the component for the relative clause.

Based on the result from the linguistic analysis mechanism 220 (target unit sequence), the linguistic prosody generation mechanism 225 annotates the target unit sequence with linguistic target to produce a linguistically annotated target unit sequence (230). When the input text 205 contains initial annotations (e.g., defined manually by a user), The linguistic analysis mechanism 220 also takes into account what is specified in the input text 205 and incorporates such original annotation with the linguistic analysis results to generate the linguistically annotated target unit sequence (230).

The target unit sequence/linguistic target 230 includes linguistic prosody annotations that specify desired prosodic properties of the synthesized speech. For example, if a phrase needs to be stressed, an appropriate unit or units of the first word of the phrase may be annotated as stressed. Therefore, the target unit sequence with linguistic target 230 may be viewed as annotated at a symbolic level, in which different units or grammatical components (each may correspond to one or more units) are specified having various linguistic prosodic characteristics, generated so that they lead to the desired speech characteristics.

The linguistic prosody generation mechanism 225 may annotate individual parts of the target unit sequence according to some pre-defined criteria. The criteria may be defined according to a target speaker's habitual speech pattern. This criteria may also be defined to follow some common speech convention. For instance, a pre-defined criterion may indicate that the beginning of a phrase should be stressed. Some words, such as emphasized words (e.g., the word "particularly"), may also be stressed. In addition, pauses may be introduced around certain syntactic boundaries (e.g., relative clause or after commas).

As an illustration, assume the input text 205 provides "The house that Jack built has some eye-catching features, especially its turn-of-the-century Victorian style." For this input, the linguistic analysis mechanism 220 may identify grammatical components such as a relative clause "that Jack built", two multi-word phrases "eye-catching" and "turn-of-the-century", a proper name "Jack", an emphasis word "especially", and a comma between word "features" and "especially". Each of such identified components may be annotated with certain linguistic prosodic characteristics. For example, for each phrase, the first component word in the phrase may be marked as stressed. The emphasis word "especially" may also be annotated as stressed. Pauses may be introduced before and after the relative clause. The word immediately before the comma may be annotated to have a longer duration and a pause may be introduced immediately after the comma.

Linguistic prosodic model Generation

As described earlier, the linguistic prosodic models 250 are established by the linguistic prosodic model generation mechanism 240 based on labeled training data 237. The established linguistic prosodic models 250 characterize different linguistic prosodic characteristics. To generate such models, the training data 237 is first created that comprises a plurality of training samples. Each training sample may correspond to a phonetic unit which may be represented as a tuple with elements such as an identity of the underlying phonetic unit, a linguistic prosody label associated with the phonetic unit, and a set of acoustic features computed from the phonetic unit.

FIG. 3(*a*) depicts the internal high level functional block diagram of the linguistic prosodic model generation mechanism 240, according to embodiments of the present invention. The linguistic prosodic model generation mechanism 240 may include a labeled training data generation mechanism 310, an acoustic feature extraction mechanism 320, a prosody label extraction mechanism 330, and a model parameter estimation mechanism 340. The labeled training data generation 310 labels training samples in the training data 237 in terms of linguistic prosodic characteristics.

FIG. 3(*b*) depicts the diagram of an exemplary labeled training data generation mechanism, according to embodiments of the present invention. The labeled training data generation mechanism 310 comprises a phonetic boundary detection mechanism 350, a linguistic prosody labelling mechanism 360, and an acoustic feature computation mechanism 370. The input to the phonetic boundary detection mechanism 350 may include both text and its corresponding speech form. The speech form may be generated by a target speaker who utters the text in a manner suitable for inclusion in the text-to-speech system database. In a preferred embodiment, the input to the phonetic boundary detection mechanism 350 may include substantially similar content as what is used to construct the unit database 255.

The phonetic boundary detection mechanism 350 may employ an automatic speech recognizer (not shown) to detect phonetic boundaries. Such a speech recognizer may be a generic or a constrained speech recognizer. A constrained speech recognizer takes a word sequence (included in the text) and identifies phonetic boundaries in the corresponding speech input consistent with the given word sequence. A generic speech recognizer takes speech data and recognizes the underlying phonetic units and their boundaries. The output of the phonetic boundary detection mechanism 350 may include a phonetic sequence with phonetic boundaries identified with respect to, for example, time.

The phonetic boundary detection mechanism 350 may also adopt a two tier processing. For example, if may first employ a speech recognizer to identify the phonetic sequence with marked boundaries. It may then employ a verification processing in which the automatically detected phonetic sequence and boundaries are verified. Such verification may be performed manually to correct inappropriately detected phonetic units or boundaries.

The linguistic prosody labeling mechanism 360 assigns linguistic prosodic labels to each phonetic unit. The linguistic prosodic labeling mechanism 360 may adopt a mechanism similar to a TTS front end (such as the TTS front end 210) to perform the task. While a TTS front end is used to generate linguistic prosodic labels, the linguistic prosody mechanism 360 may perform linguistic analysis only based on the text and label the underlying phonetic units accordingly. In a different embodiment, the linguistic prosodic labeling mechanism 360 may also utilize the phonetic sequence from the phonetic boundary detection mechanism 350 to determine how to label different phonetic units. In some situations, this may be preferable. This may be due to the fact that some words may have multiple pronunciations. For example, "the" may be pronounced like 'thee' or 'thuh'. In this case, a speech recognizer can determine which pronunciation was spoken. In FIG. 3(*a*), the linguistic prosodic labeling mechanism 360 may optionally take input from the text, the phonetic sequence, or both and its output comprises a sequence of phonetic units with linguistic prosody labels. The linguistic prosodic labelling mechanism 360 may also employ a two tiered processing. It may first adopt an automatic approach to generate linguistic prosodic labels. The automatically generated labeling may then be verified in a second tier processing so that incorrect labels may be manually corrected.

The acoustic feature computation mechanism 370 computes relevant acoustic features of each phonetic unit from the speech training data. The acoustic features of each phonetic unit may be computed from the waveform of a phonetic unit within the boundary of the unit. Some of the acoustic features such as pitch or energy may be computed from multiple overlapping windows. For example, pitch may be measured in a window of 30 milliseconds and adjacent windows may shift 10 milliseconds (i.e., overlap 20 milliseconds). Such acoustic features associated with a phonetic unit may be organized as a sequence of feature vectors.

The output from the linguistic prosodic labeling mechanism 360 and the acoustic feature computation mechanism 370 may be merged to form labeling training samples. Each phonetic unit may be associated with its identity, its linguistic prosodic label, and its acoustic feature sequence. This may be represented as a tuple: (phonetic unit, linguistic prosody label, acoustic feature sequence). Each utterance in the training speech data can then be represented as a sequence of such tuples in an order in which different phonetic units are spoken. The entire set of labeled training data 237 is then a union of all such sequences of tuples.

The labeled training data 237 may be partitioned in different ways when it is used to generate linguistic prosodic models. For example, it may be partitioned according to phonetic units. In this case, each portion in the partition may include one or more training samples (tuples) that, although all corresponding to the same phonetic unit, have different linguistic prosody labels. On the other hand, the labeled training data 237 may also be partitioned with respect to linguistic prosodic characteristics. In this case, each portion in the partition may include one or more training samples corresponding to different phonetic units with the same linguistic prosody label.

The linguistic prosodic model generation mechanism 240 establishes a linguistic prosodic model using a portion of the training data 237 that has a label corresponding to the linguistic prosody to be modeled. That is, every training sample included in such a portion has the same linguistic prosody label. For example, a portion of the training data 237 may comprise a group of tuples having phonetic units labeled as "stressed" and this particular portion may be used to train a linguistic prosodic model for the linguistic prosodic characteristic "stressed". The acoustic feature sequence associated with each training sample may be used to estimate the parameters of the model for the linguistic prosodic characteristic "stressed".

To train a linguistic prosodic model (e.g., for linguistic prosodic characteristic "stressed"), the acoustic feature extraction mechanism 320 (FIG. 3(*a*)), is capable of extracting various acoustic feature sequences from tuples of an appropriate portion of the labeled training data 37 that has a linguistic prosodic label corresponding to the underlying linguistic prosodic characteristic for which a model is to be established. The acoustic features extracted from the training data 237 may be considered as representative and, hence, used to characterize the underlying linguistic prosodic characteristic. For instance, if a stressed phoneme often has a higher pitch and energy, acoustic features pitch and energy may be used to characterize the linguistic prosodic characteristic "stressed". Different acoustic features may be used to characterize different linguistic prosodic characteristics. The determination of which set of acoustic features is used to establish which linguistic prosodic model may be an application dependent decision and the decisions may be reached empirically.

To train a linguistic prosodic model, the model parameter estimation mechanism 340 uses the acoustic features extracted from a portion of the labeled training data 237 (by the acoustic feature extraction mechanism 320) having an underlying linguistic prosodic label to estimate relevant model parameters. The types and nature of the model parameters are related to the underlying model employed. For example, a statistical model may be used to characterize the distribution of acoustic features extracted from an appropriate portion of the training data 237. In this case, acoustic features extracted from each tuple may be viewed as point projected to the underlying feature space. For instance, if pitch and energy are used to characterize linguistic prosodic characteristics related to "stress (e.g., "stressed" or "unstressed"), a pair of such features extracted from each tuple (corresponds to a single training sample) may be represented as a point in a feature space formed along dimensions defined by pitch and energy.

This is illustrated in FIG. 3(*c*), where each point in the two dimensional feature space (formed by X-axis representing "Energy" and Y-axis representing "Pitch") corresponds to a pair of acoustic feature (energy, pitch) extracted from a tuple of the training data 237. When a collection of training data labeled as "stressed" is available, a plurality of such pairs of features may be projected to the underlying feature space, forming a distribution with points labeled with "Ys" (as shown in FIG. 3(*c*)). Similarly, points from training samples corresponding to linguistic prosody "unstressed" may also form a distribution. In FIG. 3(*c*), it is shown as a cluster of points labeled as "Xs".

Such distributions may be characterized using different models. A statistical model may be used. A non-statistical model may also be employed. A decision tree may be trained and constructed through an iterative training process. Furthermore, a combination of decision tree with statistical models may also be utilized. When a statistical model is employed, parameters characterizing the underlying statistical function may be estimated using the acoustic feature values of each point.

A Gaussian function may be used to statistically model an underlying distribution. Parameters used to characterize a Gaussian function typically include mean and variance. A Gaussian function may correspond to a single Gaussian or a Gaussian mixture with a plurality of Gaussians. In the case of Gaussian mixture, each of the Gaussians may have its own mean and variance and a weighted sum of the individual Gaussian may be used to describe the overall Gaussian mixture.

Alternatively, a distribution in a multiple dimensional space may be characterized in its individual lower dimensional space. For instance, the distributions illustrated in FIG. 3(*c*) (one corresponding to points markers using "Xs" from phonetic units labeled as "unstressed" and another corresponding to points markers using "Ys" from phonetic units labeled as "stressed") may be projected onto X-axis (representing "Energy"), forming two one-dimensional distributions. Such one dimensional distributions may then be characterized using, for example, two distinct Gaussian functions.

As mentioned above, it is also possible to employ a model that is a combination of a decision tree with statistical models. FIG. 3(*d*) shows one such exemplary model in a preferred embodiment of the present invention. The binary tree illustrated in FIG. 3(*d*) represents linguistic prosodic models with respect to acoustic feature "pitch". That is, it encompasses the linguistic prosodic models expressed in "pitch" in different linguistic prosodic settings. For instance, each leaf node (e.g., leaf node 392 or 393) corresponds to a pitch model in a particular linguistic prosodic setting and each non-leaf node (e.g., non-leaf node 387) may represent a decision point (e.g., at non-leaf node 387, a decision is made in terms of whether the linguistic prosody of a phonetic units is "stressed" or "unstressed") in terms of a particular setting.

In such a tress, a decision at each non-leaf node may be preformed according to some form of classification between two classes, each of which leads to one of the two branches linked to the non-leaf node. For example, at non-leaf node 381, a decision is made in terms of whether a given phonetic unit is voiced or unvoiced. At non-leaf node 384, the decision is whether a voiced phonetic unit is a vowel or not. At non-leaf node 387, the decision is related to whether the linguistic prosody of a vowel phonetic unit is "stressed" or "unstressed". Furthermore, at non-leaf node 390, the decision is whether a "stressed" vowel phonetic unit is at the beginning of a phrase.

Each leaf node in FIG. 3(*d*) may represent a particular linguistic prosodic setting and implicate a decision path. For example, the leaf node 329 represents a linguistic prosodic setting where a given phonetic unit is a (voiced) vowel at beginning of a phrase with linguistic prosody "stressed" and this setting corresponds to a decision path traversed through nodes 381, 384, 387, 390, and 392. At each leaf node, a model may be used to represent the characteristics of the pitch feature of a phonetic unit from a particular linguistic prosodic setting specified by the decision path. For instance, the model attached to the node 392 (i.e., pitch model 394) represents the pitch characteristics of a phonetic unit that is a voiced (determined at 381), stressed (determined at 384) vowel (determined at 387) at the beginning of a phrase (determined at 390). Therefore, through a decision path, an appropriate model can be selected.

Using a pitch model (e.g., the pitch model 394) attached to a leaf node (e.g., the leaf node 392), a phonetic unit (from the unit database 255) can be evaluated in terms of how likely the phonetic unit possesses the pitch characteristics described by the pitch model 392. For instance, if a target unit in the target sequence 230 is annotated as a stressed vowel at the beginning of a phrase, to determine whether a phonetic unit from the unit database 255 can be used as a candidate unit, the pitch model 394 can be used to evaluate how likely the unit from the unit database has the desirable pitch property characterized by the pitch model 394. Specifically, for example, the pitch value of the unit may be computed (or extracted) and used to estimate a probability against the pitch model 394.

The model used at each leaf node can be a statistical model. For instance, it can be a one dimensional Gaussian or a Gaussian mixture in one dimensional space (pitch dimension). Other functions may also be used for such modeling purposes.

To generate a model such as the one illustrated in FIG. 3(*d*), training may be performed at multiple stages. Training at one stage may aim at establishing a decision tree. This decision tree divides training samples into a number of groups and each group represents a leaf node in the tree. Training may be performed one decision node at a time. Different methods of training at each node may be adopted. For instance, a regression approach may be adopted at each node (e.g., the non-leaf node 381) so that the distortion among the training samples assigned to each branch of the decision node is minimized. An alternative approach may be an iterative approach that minimizes classification error (e.g., between "voiced" and "unvoiced"). Once the training at this node converges (or reach a pre-defined level of satisfaction), the non-leaf node 384 may be trained using the training samples that fall within "voiced" category achieved at the previous stage (at node 381). The process continues until reaching the leaf node level. The second stage may involve training models attached to every leaf node. At each leaf node, the training samples retained are used to construct the model attached to the node. For example, the pitch feature values of the training samples retained at node 392 can be used to train the pitch model 394.

A regression tree may also be organized in different fashions. For example, as discussed above, each tree may be used to represent one acoustic feature. Alternatively, a tree may also represent multiple features. The tree illustrated in FIG. 3(*d*) may be used to represent the combination of pitch and energy features. In this case, each leaf node in FIG. 3(*d*) may be attached a model that characterizes an underlying linguistic prosody in terms of both pitch and energy. In either case, a statistical model may be used at each leaf node which may be a single Gaussian or a Gaussian mixture.

It is also possible to use a tree to represent a single phonetic unit. In this case, the leaf nodes of a tree represent different linguistic prosodics of the phonetic unit. For instance, one leaf node may represent the linguistic prosodic model of a phonetic unit when the phonetic unit is stressed and another leaf node may correspond to the linguistic prosodic model of the phonetic unit when it is not stressed. The model at each leaf node may be generated based on a single or multiple acoustic features. For example, acoustic feature "duration" may be characterized at each leaf node. Using this construction, a tree is trained for each phonetic unit based on training samples that correspond to the same phonetic unit label with different linguistic prosody labels.

Different tree constructions mentioned above may also be used in a combined fashion. For instance, a single tree may be designated to modeling the pitch characteristics and another tree to model the energy. These two trees may be trained against all phonetic units. In addition, a tree can be trained for each phonetic unit, wherein models attached to the leaf nodes in each tree represent the duration characteristics under different linguistic prosody labels. Another alternative combination may be to train one tree for the combination of both pitch and energy and then a plurality of trees, each of which is trained to model the duration characteristics of a particular phonetic unit under different linguistic prosodic labelings.

With reference to FIG. 3(*a*), the model parameter estimation mechanism 340 trains underlying models adopted (e.g., a Gaussian or a regression tree) by estimating the model parameters based on acoustic features extracted from the labeled training data 237. The estimated model parameters are then used, together with the prosody label (extracted by the prosody label extraction mechanism 330 from the labeled training data 237), to form linguistic prosodic models 250. Depending on the model construction adopted, a linguistic prosodic model may be expressed differently. For instance, a regression tree model may be represented as an attributed graph, wherein each non-leaf node may have an symbolic attribute set (e.g., with attribute "stressed" and "unstressed" serving as a classification criteria used at the node) and each of the leaf node may have a numeric attribute set (e.g., comprising one or more model parameters).

Such established models may be used (by the unit selection mechanism 260) to determine which phonetic units (from the unit database 255) are to be used to synthesize speech based on the target unit sequence with linguistic target 230.

Unit Selection Using Linguistic Prosodic Models

Based on the target unit sequence/linguistic target 230 (see FIG. 2), the unit selection mechanism 260 produces a selected unit sequence 265, as its output, selected from one or more candidate unit sequences based on Joint cost. The selection process is an optimization process, in which each candidate unit sequence may be evaluated in terms of a joint cost. A candidate unit sequence may comprise a plurality of phonetic units arranged in an order consistent with the given target unit sequence 230. Each candidate unit sequence may be selected so that it satisfies, within some given limit, the requirements set forth by the target unit sequence and the linguistic target (230). That is, candidate unit sequences are selected in accordance with both the composition of the target units specified in the target unit sequence and the linguistic prosodic characteristics with respect to the target units.

To select an optimal unit sequence, the unit selection mechanism 260 utilizes the linguistic prosodic models 250 to evaluate how closely the linguistic prosodic characteristics achieved or realized by each candidate unit sequence match with the given linguistic target. Such evaluation may be performed with respect to a joint cost associated with each candidate unit sequence. The final selected unit sequence 265 is optimized to reach a minimum joint cost or to maximize the similarity between the target unit sequence/linguistic target 230 and the selected unit sequence measured in terms of different aspects.

Figure 4:
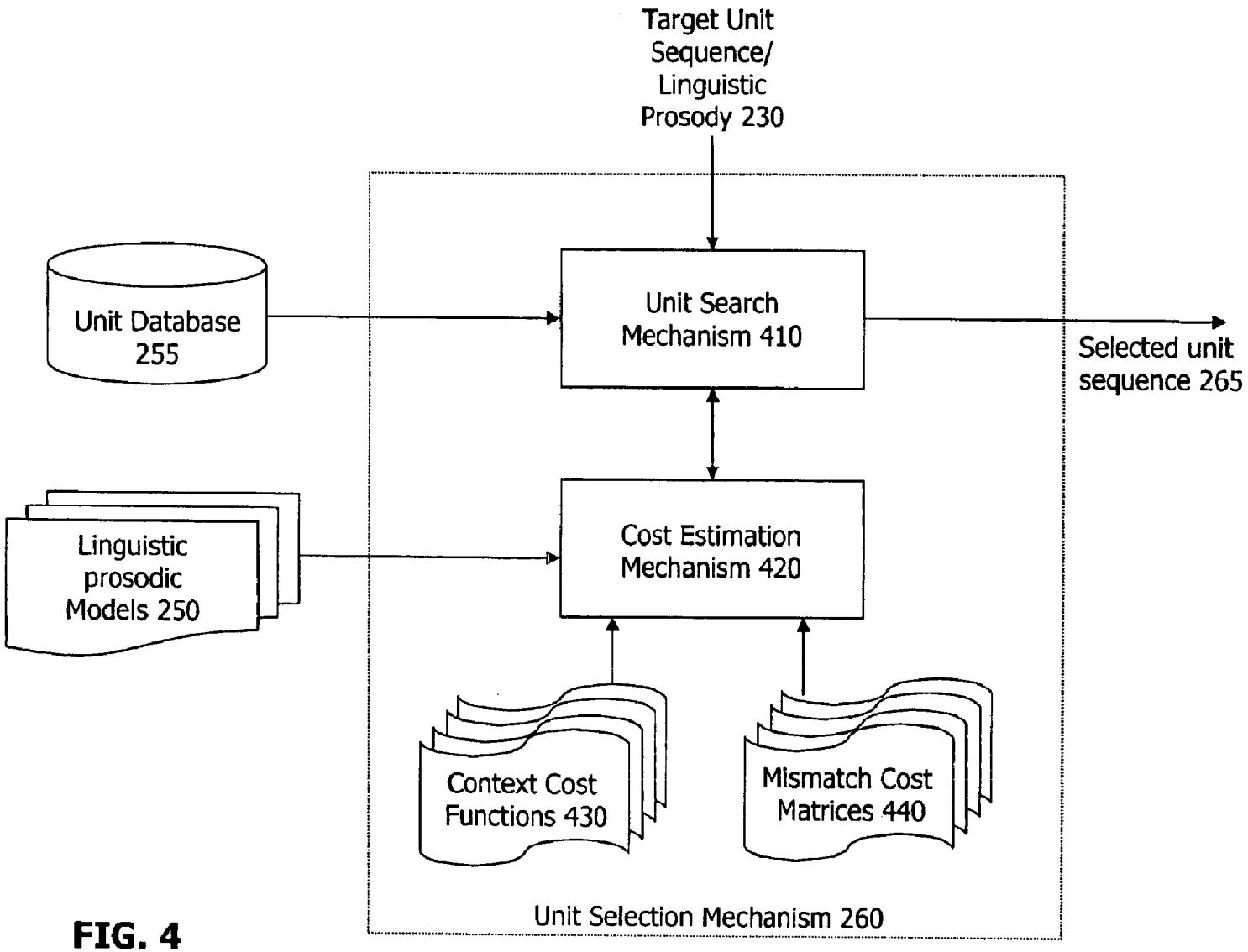
FIG. 4 depicts the internal high level functional block diagram of an exemplary unit selection mechanism that selects units using linguistic prosodic models, according to embodiments of the present invention.

FIG. 4 depicts the internal high level functional block diagram of the unit selection mechanism 260 that selects phonetic units from a unit database according to the target unit sequence 230 with a linguistic target to minimize a joint cost computed using the linguistic prosodic models 250, according to embodiments of the present invention. The unit selection mechanism 260 includes a unit search mechanism 410, a cost estimation mechanism 420, and one or more sets of pre-defined cost related information (e.g., context cost functions 430 and mismatch cost matrices 440). The unit search mechanism 410 identifies candidate unit sequences that satisfy, within certain limitation, the requirement specified in the annotated target unit sequence.

For each of the candidate unit sequences identified by the unit search mechanism 410, the cost estimation mechanism 420 computes a joint cost based on the linguistic prosodic models 250 and one or more sets of pre-defined cost related information (i.e., 430 and 440). The computed joint cost information is fed back to the unit search mechanism 410 so that one candidate unit sequence corresponding to a minimum joint cost can be determined as the selected unit sequence 265.

The joint cost associated with a candidate unit sequence may estimate how well the speech synthesized using the candidate unit sequence satisfies desired speech properties specified in the target unit sequence. In other words, the joint cost characterizes the deviation between the speech properties realized using the candidate unit sequence and the desired speech properties. Unit selection is performed by minimizing such a deviation.

Figure 5A:
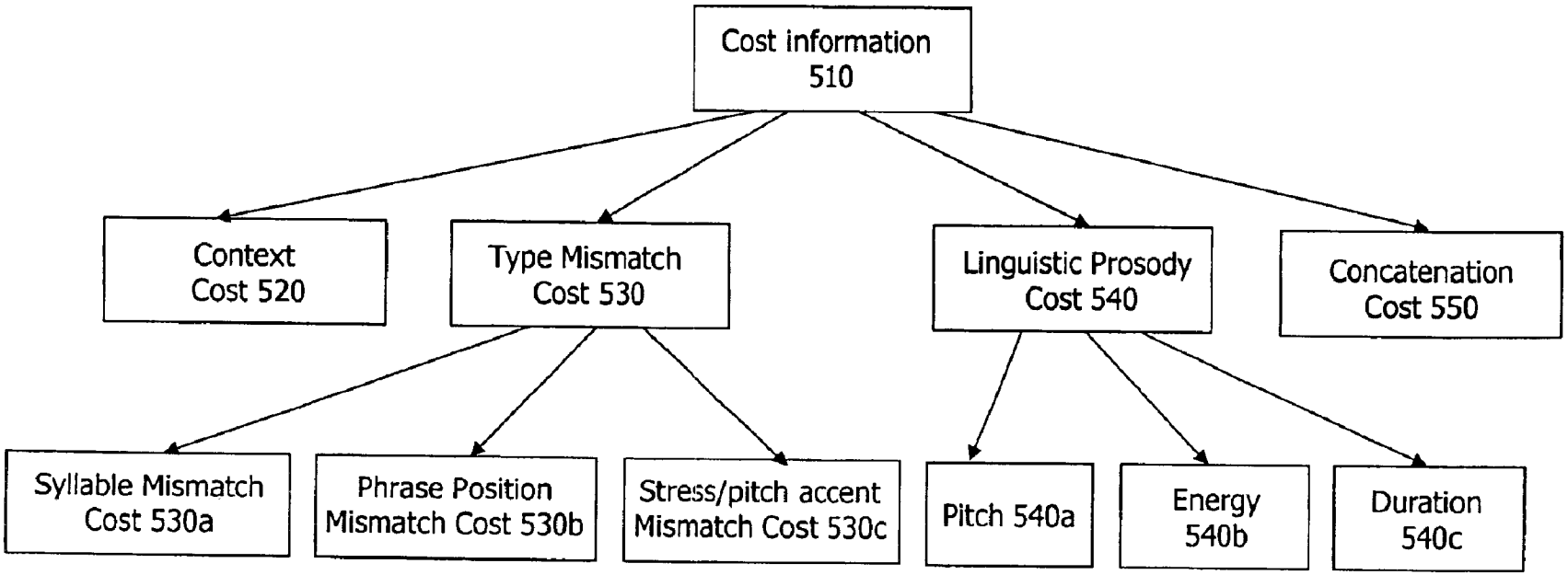
FIG. 5(*a*) illustrates exemplary types of costs associated with a unit sequence, according to embodiments of the present invention.
Figure 5B:
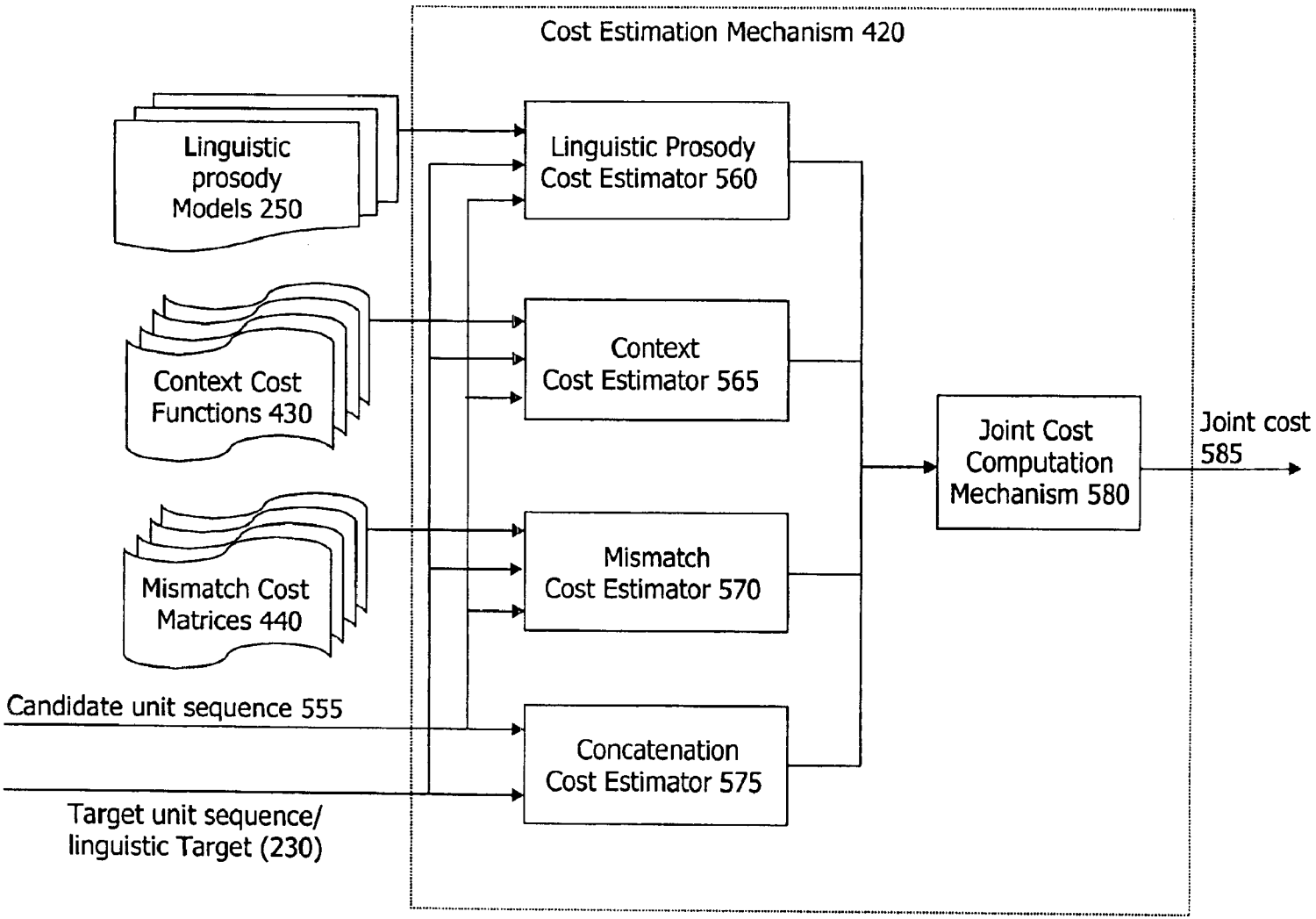

Joint cost may be designed to measure the deviation in terms of different aspects of speech. For instance, discrepancy in speech quality may be due to the difference between phonetic units desired and actual phonetic units selected (e.g., some desired phonetic unit may not be available in the unit database 255). Discrepancy in speech quality may also be due to how different phonetic units are concatenated. In addition, when a candidate phonetic unit is from a different context than the context which a desired phonetic unit is from, it may also lead to difference in speech quality. FIG. 5(*a*) illustrates exemplary aspects of the joint cost associated with a unit sequence, according to embodiments of the present invention. Joint cost 510 associated with a unit sequence (e.g., a candidate unit sequence) may include aspects of context cost 520, type mismatch cost 530, linguistic prosody cost 540, and concatenation cost 550.

The linguistic prosody cost 540 may characterize the cost related to difference between desired linguistic prosody (specified in the linguistically annotated target unit sequence 230) and achieved linguistic prosody (via a selected unit sequence). A specific linguistic prosody may be characterized using appropriate acoustic features. For example, acoustic features such as pitch 540*a*, energy 540*b*, and duration 540*c* associated with an underlying phonetic unit (e.g., a phoneme) may be relevant with respect to certain linguistic prosodic characteristics. Difference between desired linguistic prosody and achieved linguistic prosody may be measured according to the discrepancy between corresponding acoustic features. As an illustration, if the pitch computed from a selected phoneme differs from corresponding desired pitch (e.g., represented via a linguistic prosodic model), such a discrepancy in pitch may lead to different sound in synthesized speech. The bigger the difference in acoustic features, the more the resulting speech deviates from desired speech.

To compute the linguistic prosody cost (540) associated with a unit, desired linguistic prosodic characteristics of a target unit may be compared with achieved linguistic prosodic characteristics using a selected unit. The discrepancy may be characterized in various ways. One approach is to characterize the difference between the desired and the achieved through appropriate acoustic features. For example, a desired linguistic prosody may be expressed (via a linguistic prosodic model) in terms of some acoustic feature values which can be used to compare with the acoustic feature values computed from a selected unit (the comparison may be done in a normalized fashion). The difference reflects the discrepancy. The higher the difference, the higher the cost.

The evaluation may also be performed in a probabilistic fashion. For example, instead of comparing the feature values directly, the feature values computed from a candidate unit may be used to estimate a posterior probability against an appropriate linguistic prosodic model corresponding to the desired linguistic prosody associated with the target unit. In this case, the higher the probability, the lower the cost or the more likely the candidate unit possesses the desired linguistic prosody.

A linguistic prosodic model used in evaluating the discrepancy can be retrieved according to the linguistic annotation of a target unit. Using above mentioned exemplary linguistic prosodic models (e.g., regression tree in FIG. 3(*d*)), for instance, an appropriate linguistic prosodic model may be retrieved by traversing through a regression tree. If a target unit is annotated (or labeled) as a voiced stressed vowel at the beginning of a phrase, using the model regression tree illustrated in FIG. 3(*d*), the pitch model 394 attached to the leaf node 392 can be retrieved. The retrieved model (394) may be represented as, for example, a set of parameters characterizing a Gaussian function. It may also be represented as a set of feature vectors (e.g., as a distribution). When a linguistic prosodic model relates to different trees (e.g., "stressed" may relate to both pitch and energy and pitch and energy models for "stressed" may be embedded in two different trees), each model may be retrieved separately and evaluation may be performed individually against each model. The separate evaluation results may then be combined in a meaningful manner in order to assess the overall discrepancy.

Alternatively, the discrepancy may also be evaluated using some other form of computation. For instance, a function, such as the negative log of the probability, may be used to compute the cost based on an estimated probability. In this case, the higher the estimated probability, the lower the cost associated with the selected unit.

The joint cost 510 may also include measures that characterize the discrepancy between a target unit and a selected unit in terms of context mismatch (520), wherein context is defined as the phonetic context of a particular phonetic unit. For example, the phoneme /a/ from the word "father" has a different context than the context of the phoneme /a/ from the word "pot". In speech synthesis, the sound of a phonetic unit may be affected by its context. Therefore, context mismatch may introduce undesirable effects in synthesized speech. The context cost due to the discrepancy between a target unit and a selected unit is used to describe the undesirable effects caused by the context mismatch.

Context mismatch may occur, for example, when a desired context of a target unit cannot be found in a unit database. For instance, if the input text 205 includes the word "pot" which has a /a/ sound. The target unit sequence generated based on this input text includes a desired phoneme /a/ for the word "pot". If the unit database 255 has only a unit corresponding to phoneme /a/ appearing in the word "pop" (a different context), there is a context mismatch. In this example, even though the /t/ sound as in the word "pot" and the /p/ sound as in the word "pop" are both consonants, one (/t/) is a dental (the sound is made at the teeth) and the other (/p/) is a labial (the sound is made at the lips). This contextual difference affects the sound of the previous phoneme /a/. Therefore, even though the phoneme /a/ in the unit database 255 matches the desired phoneme, the synthesized sound using the phoneme "/a/" selected from the context of "pop" is not the same as the desired sound determined by the context of "pot". The magnitude of this effect is represented by the context cost 520 and may be estimated according to some pre-defined context cost function 430 (see FIG. 4). The context cost function 430 may be defined in terms of different types of context mismatch. The bigger the difference in context, the higher the cost, corresponding to a bigger expected deviation from the desired sound. For example, the cost due to context mismatch between "pot" and "rock" may be higher than that between "pot" and "pop".

The joint cost 510 may also characterize the quality of synthesized speech in terms of how well the type of a selected unit matches the type of a target unit. A selected unit may be a mismatched due to syllable mismatch, phrase position mismatch, or stress/pitch accent mismatch. Each type of mismatch may introduce cost corresponding to a syllable mismatch cost 530*a*, a phrase position cost 530*b*, and a stress/pitch accent mismatch cost 530*c*. One illustration of a syllable mismatch is the following. Assume the input text is "The moon is white" based on which the target unit sequence includes a phoneme /n/ in the context of "moon" and "is". That is, the /n/ in the target sequence is an ending phoneme in syllable "moon" (which has a proceeding phoneme /u/) and followed by another syllable "is" (which has a starting phoneme /I/). If the unit database 255 has only a /n/ phoneme from "you knit" where although /n/ is also proceeded by a vowel /u/ and followed by /I/, the syllable position of /n/ here is the beginning position of syllable "nit", which is not the same as what is desired in the target unit sequence (i.e., being the end position of a syllable). That is, the selected /n/ is both from a mismatched syllable and at a wrong position within a syllable. In this case, even though the context of the selected phoneme is the same as the desired context, the mismatch in syllable positions leads to different sounds in the synthesized speech.

An illustration to phrase position mismatch is provided. Assume an input text is "Cats are cute", in which the word "Cats" is at the beginning of a syntactic phrase. Words at the beginning of a phrase often have higher energy and a shorter duration than words at the end of a phrase. Therefore, if phonemes corresponding to the word "cats" are selected from a sentence "Many people like cats", in which the word "cats" is at the end of a phrase, the resulting synthesized speech may not sound like what is desired. In this case, there is a cost associated with such a phrase position mismatch.

The joint cost 510 may further evaluate synthesized speech in terms of transitions between adjacent units. This aspect of cost may be referred to as concatenation cost 550. Homogeneous acoustic features across adjacent units may yield a smooth transition, which may correspond to more natural sound and accordingly lower concatenation cost. Abrupt transitions may occur due to sudden changes in acoustic properties that yield unnatural speech, hence, higher concatenation cost.

The concatenation cost 550 may be computed based on discrepancy in acoustic features of the waveforms of adjacent units measured at points of concatenation. For instance, concatenation cost of the transition between two adjacent phonemes may be measured as the difference in cepstra computed from two corresponding waveforms near the point of the concatenation. The larger the difference is, the less smooth the transition of the adjacent phonemes.

To compute these different aspects of the joint cost associated with each candidate unit sequence, the cost estimation mechanism 420 comprises, as depicted in FIG. 5(*b*), a linguistic prosody cost estimator 560, a context cost estimator 565, a mismatch cost estimator 570, a concatenation cost estimator 575, and a joint cost computation mechanism 580. Each of the estimators takes the target unit sequence with the linguistic target 230 and a candidate unit sequence (555) as input and computes the cost with respect to relevant aspects. Each estimator may utilize different information during the estimation. For example, to estimate the linguistic prosody cost, the estimator 560 utilizes the linguistic prosodic models 250 to compute the discrepancy between desired linguistic prosody (specified in the target unit sequence/linguistic target 230) and the linguistic prosody achieved by the candidate unit sequence 555. The context cost estimator 565 may rely on the pre-defined context cost functions 430 to compute context related cost.

The joint cost computation mechanism 580 computes a joint cost associated with the candidate unit sequence 555 that estimates the deviation between desired speech properties and achieved speech properties. The joint cost may be evaluated based on different aspects of the cost such as the ones mentioned above. For example, the joint cost may be computed simply as a summation of all different aspects of the costs associated with individual phonetic units. Different cost aspects may also be weighted.

Weights assigned to different costs may be determined in a variety of methods. For instance, they may be determined according to application needs. Alternatively, weights may be determined empirically, either manually or automatically. To adjust weights automatically, desired speech may be recorded to serve as ground truth. Synthesized speech of the same content may be generated and compared with the ground truth. The weights may be adjusted so that the distance (discrepancy) between the ground truth and the generated speech (using the weights) is minimized.

In unit selection based text to speech processing, a plurality of unit sequences may be considered and a final selection may be determined through minimizing the joint cost. The optimization may be achieved through, for example, dynamic programming.

Process Flows

Figure 6:
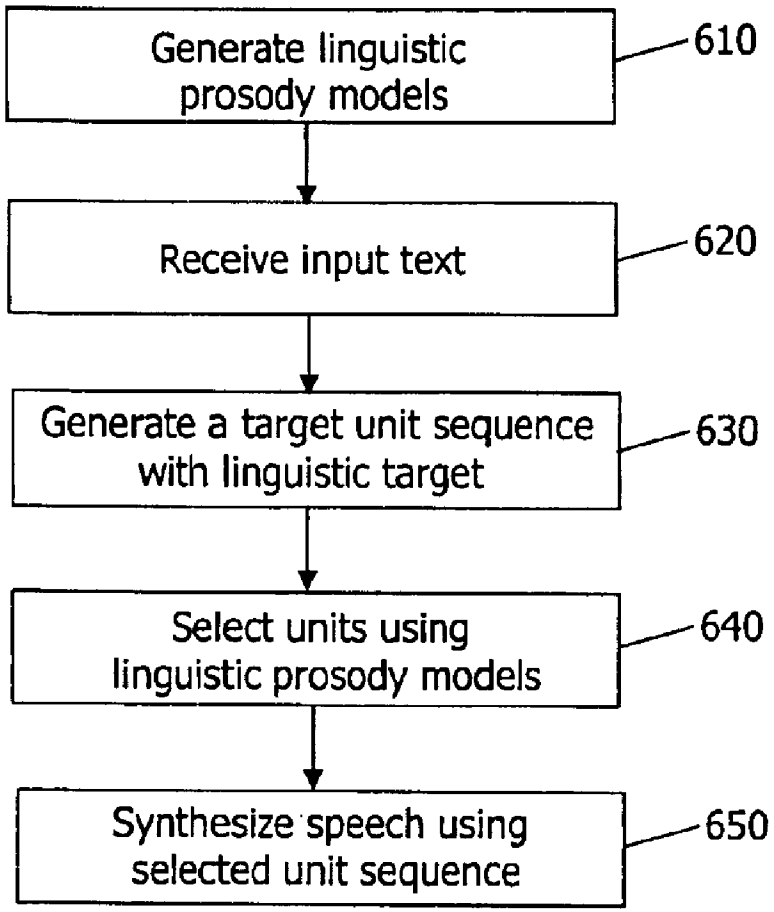
FIG. 6 is a flowchart of an exemplary process, in which unit-selection based text to speech is performed with respect to a target unit sequence with linguistic targets using linguistic prosodic models, according to embodiments of the present invention.

FIG. 6 is a flowchart of an exemplary process, in which unit-selection based text to speech is performed using phonetic units selected using linguistic prosodic models, according to embodiments of the present invention. Linguistic prosodic models representing a plurality of linguistic prosodic characteristics are first generated, at act 610, based on labeled training data 237. The established linguistic prosodic models (250) are used, during text to speech processing, to facilitate selection of phonetic units with desired linguistic prosodic characteristics. Details related to how linguistic prosodic models are generated are discussed with reference to FIG. 7.

When an input text (e.g., 205) is received, at act 620, the TTS front end 210 generates, at act 630, a target unit sequence with linguistic target 230. Based on the given target unit sequence 230 with annotated linguistic prosodic characteristics, the unit selection mechanism 260 selects, at act 640, phonetic units from the unit database 255 based on joint cost estimated using the linguistic prosodic models 250. Details of how the selected unit sequence are determined to minimize the joint cost are described with reference to FIG. 8. Such selected unit sequence 265 is then used, at act 650, to synthesize speech corresponding to the input text 204.

Figure 7:
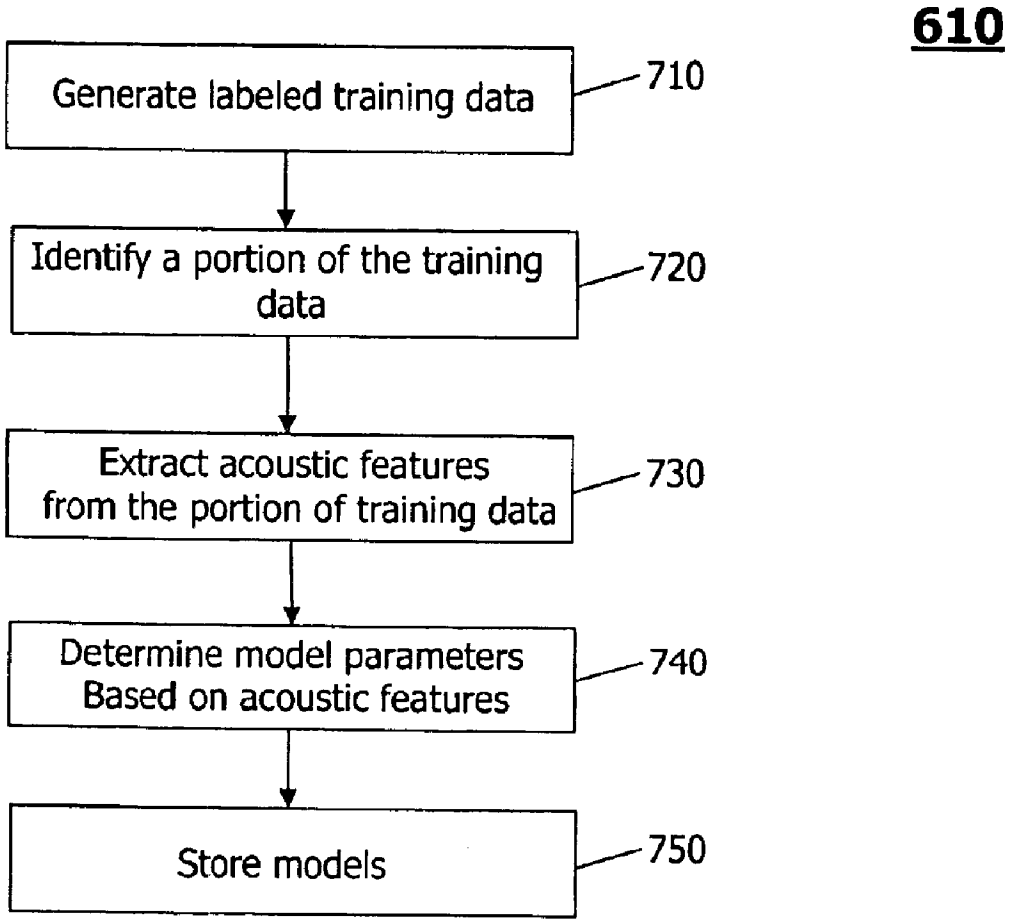
FIG. 7 is a flowchart of an exemplary process, in which linguistic prosodic models are established based on labels training data, according to embodiments of the present invention.

FIG. 7 is a flowchart of an exemplary process, in which linguistic prosodic models 250 are established based on the labeled training data 237, according to embodiments of the present invention. Labeled training data is first generated, at act 710, using, for example, the mechanism described with reference to FIG. 3(*b*). To generate a linguistic prosodic model for a particular linguistic prosody, a portion of the training data 237 is identified, at act 720, that may include a plurality of training samples, each of which has a label corresponding to the particular linguistic prosody. Depending on the models adopted, act 720 may be performed using different procedures. For instance, if regression tree models are used, identifying different portions of the training data may involve establishing the trees via training. In this case, each leaf node in a trained tree corresponds to a portion of the training data that will be used to further establish the model to be attached to the leaf node. On the other hand, if statistical models (e.g., Gaussian mixtures) are used to directly model different linguistic prosodic characteristics (i.e., no decision tree is involved), a portion of the training data used to train a Gaussian mixture function may be identified according to linguistic prosody labels.

To establish linguistic prosodic models (e.g., for a leaf node), acoustic features are extracted, at act 730, from an identified portion of the training data. The acoustic features from each training sample correspond to a feature vector or a point in a feature space defined by the underlying acoustic features. Feature vectors estimated from all the training samples from the same portion of the training data form a distribution in the feature space. Parameters that characterize the adopted model (e.g., mean and variance of a Gaussian function) may then be estimated, at act 740, from the distribution. The linguistic prosodic models trained in the above exemplary procedure are then stored at act 750.

Figure 8:
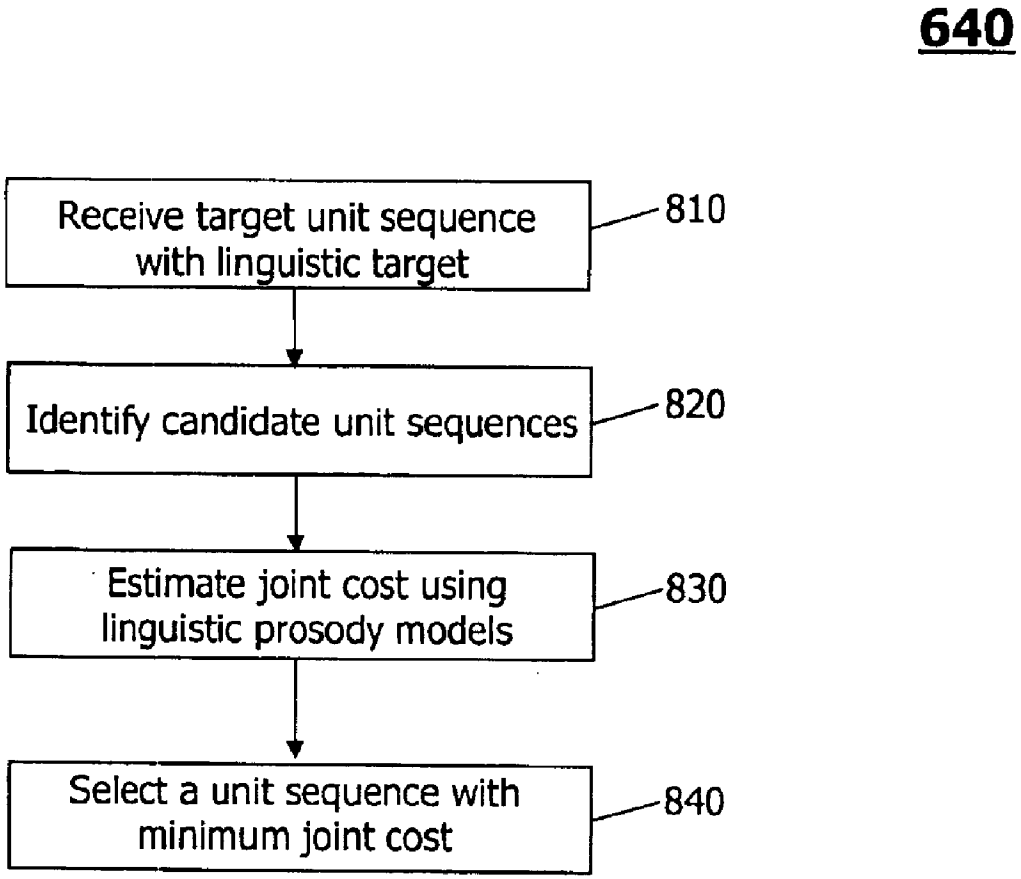
FIG. 8 is a flowchart of an exemplary process, in which a sequence of phonetic units are selected in accordance with a target unit sequence to minimize a joint cost computed using relevant linguistic prosodic models.

FIG. 8 is a flowchart of an exemplary process, in which the unit selection mechanism 260 selects a sequence of phonetic units according to a target unit sequence with specified linguistic target to minimize a joint cost computed using linguistic prosodic models. The unit selection mechanism 260 first receives, at act 810, a target unit sequence that is annotated with linguistic prosodic characteristics. According to the annotated target unit sequence 230, the unit selection mechanism 260 searches, at act 820, one or more candidate unit sequences. A joint cost associated with each candidate unit is estimated, at act 830, using linguistic prosodic models 250. Detailed description of joint cost estimation is presented with reference to FIG. 9. One of the candidate unit sequences is selected, at act 840, so that the joint cost associated with the selected unit sequence is minimum.

Figure 9:
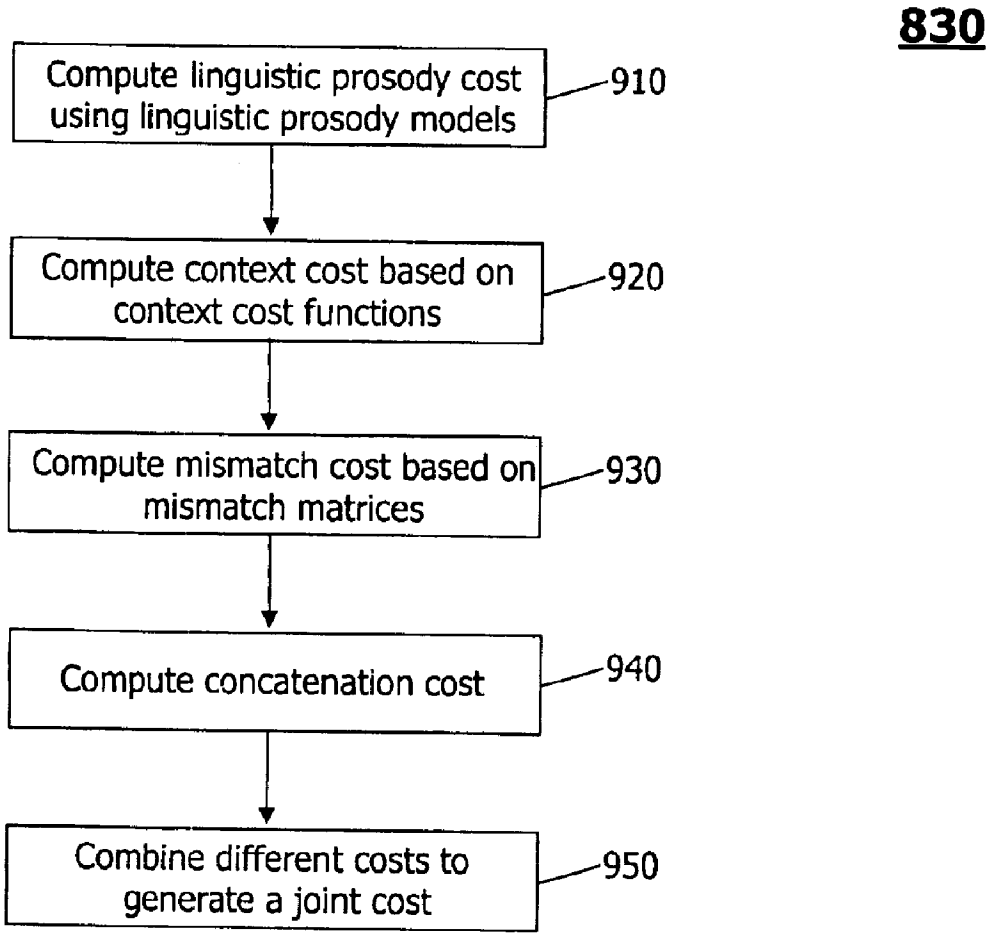
FIG. 9 is a flowchart of an exemplary process, in which a joint cost associated with a unit sequence is computed using linguistic prosodic models, according to embodiments of the present invention.

FIG. 9 is a flowchart of an exemplary process, in which a joint cost associated with a candidate unit sequence is computed using linguistic prosodic models, according to embodiments of the present invention. For each candidate unit sequence, its linguistic prosody cost is computed, at act 910, using relevant linguistic prosodic models. The estimated linguistic prosody cost represents the discrepancy between desired and achieved speech effect. The overall linguistic prosody cost may be computed as, for example, a summation of costs associated with all the individual units. A weighted sum may also be used to compute the overall linguistic prosody cost.

The context cost of a candidate unit sequence is computed at act 920. The overall context cost of a unit sequence may be similarly defined as, for example, a summation (weighted or not) of individual context cost associated with individual units. An individual context cost associated with a single unit may be estimated based on the discrepancy between the context of a selected unit and the context of a target unit using one or more pre-defined context cost functions.

Similarly, mismatch cost of a candidate unit sequence may be computed, at act 930. The overall mismatch cost of a unit sequence may be computed as, for example, a summation of individual mismatch costs associated with individual units in the unit sequence. The mismatch cost of a particular phonetic unit may be estimated according to different aspect of mismatch. For example, a syllable mismatch cost of a selected unit may be computed based on the discrepancy between the syllable position of the selected unit and the desired syllable position of the corresponding target unit according to some pre-determined syllable position mismatch matrices. Similarly, a phrase position mismatch cost of a selected unit may be computed based on the discrepancy between the phrase position of the selected unit and the desired phrase position of the corresponding target unit according to some pre-determined phrase position mismatch matrices. The concatenation cost of a unit sequence is then computed at act 940.

The joint cost of the candidate unit sequence is finally estimated by combining, at act 950, different costs associated with various aspects of the candidate unit sequence. Such estimated joint cost is used in selecting a candidate unit sequence with minimum joint cost as the selected unit sequence 265.

While the invention has been described with reference to the certain illustrated embodiments, the words that have been used herein are words of description, rather than words of limitation. Changes may be made, within the purview of the appended claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the appended claims.

What is claimed is:

1. A method, comprising:

generating at least one linguistic prosodic model, each of the at least one linguistic prosodic model characterizing a corresponding linguistic prosody and being used to facilitate unit selection during text to speech processing, wherein the at least one linguistic prosodic model is generated from the recorded speech of a target speaker;

receiving an input text for text to speech processing;

generating, according to the input text, a target unit sequence and a linguistic target which annotates the target units in the target unit sequence with a plurality of linguistic prosodic characteristics so that the speech synthesized in accordance with the target unit sequence and the linguistic target has certain desired prosodic properties; and producing synthesized speech using a selected unit sequence determined in accordance with the target unit sequence and the linguistic target based on an estimated joint cost;

wherein estimating the joint cost comprises computing a linguistic prosody cost based on the at least one linguistic prosodic model;

computing a context cost based on at least one context cost function;

computing a mismatch cost based on a syllable position mismatch matrix with elements defining costs associated with different types of syllable position mismatch, a phrase position mismatch matrix with elements defining costs associated with different types of phrase position mismatch, and a stress/pitch accent mismatch matrix with elements defining costs associated with different types of stress/pitch accent mismatch;

computing a concatenation cost; and combining the linguistic prosody cost, the context cost, the mismatch cost, and the concatenation cost to generate the joint cost.

2. The method according to claim 1, wherein the at least one model includes at least one of:

a distribution in a feature space;

a function represented by one or more parameters; and a decision tree.

3. The method according to claim 2, wherein the function includes a statistical function.

4. The method according to claim 3, wherein the statistical function includes a Gaussian function.

5. The method according to claim 1, wherein a unit includes any combination of any sequence of contiguous or non-contiguous half-phase units.

6. The method according to claim 1, wherein said generating at least one linguistic prosodic model comprises:

generating labeled training data, wherein each training sample in the labeled training data is labeled with at least one linguistic prosody;

identifying a portion of the labeled training data with at least one training sample that has a label corresponding to a distinct linguistic prosody to be modeled;

extracting at least one acoustic feature from each training sample within the portion of the labeled training data;

determining one or more parameters of a linguistic prosodic model based on the at least one acoustic feature, wherein the one or more parameters represent the linguistic prosodic model that characterizes the distinct linguistic prosody.

7. The method according to claim 6, wherein said identifying comprises:

training a decision tree using the labeled training data, wherein leaf nodes of the decision tree correspond to different portions of the labeled training data;

selecting one leaf node in the decision tree that corresponds to the distinct linguistic prosody to be modeled.

8. The method according to claim 6, wherein said identifying comprises determining the portion of the labeled training data based on a label representing the distinct linguistic prosody to be modeled.

9. The method according to claim 1, wherein said producing synthesized speech comprises:

receiving the target unit sequence with the linguistic target;

identifying one or more candidate unit sequences, each of which comprises a plurality of units selected in accordance with the target unit sequence and the linguistic target;

selecting one of the candidate unit sequences as the selected unit sequence that has a minimum joint cost; and synthesizing the speech using the selected until sequence.

10. The method according to claim 1, wherein the linguistic prosody cost includes at least one of:

a pitch cost;

an energy cost; and a duration cost.

11. The method according to claim 1, wherein the joint cost is computed as a linear combination of the linguistic prosody cost, the context cost, the mismatch cost, and the concatenation cost.

12. The method according to claim 11, wherein the linear combination includes any one of:

a summation; and a weighted sum.

13. The method according to claim 1, wherein the linguistic prosodic model includes at least one of:

a distribution in a feature space;

a function represented by one or more parameters; and a decision tree.

14. The method according to claim 13, wherein the function includes a statistical function.

15. The method according to claim 14, wherein the statistical function includes a Gaussian function.

16. A method for unit selection using at least one linguistic prosodic model, comprising:

receiving a target unit sequence with a linguistic target, wherein the linguistic target annotates the target units in the target unit sequence with a plurality of linguistic prosodic characteristics so that the speech synthesized in accordance with the target unit sequence and the linguistic target has certain desired prosodic properties;

identifying one or more candidate unit sequences, each of which comprises a plurality of units selected in accordance with the target unit sequence and the linguistic target;

estimating a joint cost associated with each of the candidate unit sequences, wherein said estimating the joint cost comprises computing a linguistic prosody cost based on the at least one linguistic prosodic model, computing a context cost based on at least one context cost function, computing a mismatch cost based on a syllable mismatch matrix with elements defining costs associated with different types of syllable mismatch, a phrase position mismatch matrix with elements defining costs associated with different types of phrase position mismatch, and a stress/pitch accent mismatch matrix with elements defining costs associated with the different types of stress/pitch accent mismatch; computing a concatenation cost; combining the linguistic prosody cost, the context cost, the mismatch cost, and the concatenation cost to generate the joint cost; and selecting one of the candidate unit sequences to be a selected unit sequence that has a minimum joint cost.

17. The method according to claim 16, wherein the linguistic prosody cost includes at least one of:

a pitch cost;

an energy cost; and a duration cost.

18. The method according to claim 16, wherein the joint cost is computed as an linear combination of the linguistic prosody cost the context cost the mismatch cost and the concatenation cost.

19. The method according to claim 18, wherein the linear combination includes any one of:

a summation; and a weighted sum.

20. A unit selection based text to speech system, comprising:

a linguistic prosodic model generation mechanism;

a text-to-speech front end capable of generating, according to an input text, a target unit sequence and a linguistic target that annotates the target units in the target unit sequence with a plurality of linguistic prosodic characteristics so that the speech synthesized in accordance with the target sequence and the linguistic target has certain desired prosodic properties;

a unit selection mechanism capable of selecting a unit sequence in accordance with the target unit sequence and the linguistic target based on an estimated joint cost wherein estimating the joint cost comprises computing a linguistic prosody cost based on the at least one linguistic prosodic model, computing a context cost based on at least one context cost function, computing a mismatch cost based on a syllable mismatch matrix with elements defining costs associated with different types of syllable mismatch, a phrase position mismatch matrix with elements defining costs associated with different types of phrase position mismatch, and a stress/pitch accent mismatch matrix with elements defining costs associated with different types of stress/pitch accent mismatch; computing a concatenation cost; combining the linguistic prosody cost, the context cost, the mismatch cost, and the concatenation cost to generate the joint cost; and a speech synthesis mechanism capable of synthesizing speech using the selected unit sequence.

21. The system according to claim 20, wherein the text-to-speech front end comprises:

a text normalization mechanism capable of normalizing an input text for text-to-speech processing to produce a normalized text;

a linguistic analysis mechanism capable of performing linguistic analysis on the normalized text to produce the target unit sequence; and a linguistic target generation mechanism capable of generating the linguistic target with respect to the target unit sequence.

22. The system according to claim 20, wherein the linguistic prosodic model generation mechanism comprises:

an acoustic feature extraction mechanism capable of extracting, for each linguistic prosodic model to be generated, at least one acoustic feature from a portion of labeled training data, wherein training samples included in the portion have a distinct label corresponding to a linguistic prosody to be modeled; and a model parameter estimation mechanism capable of determining one or more parameters of the linguistic prosodic model based on the at least one acoustic feature.

23. The system according to claim 20, wherein the unit selection mechanism comprises:

a unit search mechanism capable of identifying one or more candidate unit sequences, each of which comprises a plurality of units selected in accordance with the target unit sequence and the linguistic target;

a cost estimation mechanism capable of estimating a joint cost for each of the candidate unit sequences using the at least one linguistic prosodic model; and a unit sequence selection mechanism capable of selecting one of the candidate unit sequence as the selected unit sequence that has a minimum joint cost.

24. The mechanism according to claim 20, wherein the linguistic prosodic model includes at least one of:

a distribution;

a function represented by one or more parameters; and a decision tree.

25. The mechanism according to claim 24, wherein the function includes a statistical function.

26. A unit selection mechanism, comprising:

a unit search mechanism capable of identifying one or more candidate unit sequences in accordance with a target unit sequence and a linguistic target, wherein the linguistic target annotates the target unit sequence with a plurality of linguistic prosodic characteristics so that speech synthesized based on the target unit sequence and the linguistic target has certain desired prosodic properties;

a cost estimation mechanism capable of estimating a joint cost, for each of the candidate unit sequences, using at least one linguistic prosodic model generated to characterize at least one linguistic prosody;

wherein the cost estimation mechanism comprises a linguistic prosody cost estimator capable of computing a linguistic prosody cost associated with a candidate unit sequence based on at least some of the linguistic prosodic models, a mismatch cost estimator capable of computing a mismatch cost of the candidate unit sequence based on a syllable mismatch matrix with elements defining costs associated with syllable mismatches, a phrase position mismatch matrix with elements defining costs associated with phrase position mismatches, and a stress/pitch accent mismatch matrix with elements defining costs associated with different types of stress/pitch accent mismatch;

a context cost estimator capable of computing a context cost of the candidate unit sequence based on context cost functions;

a concatenation cost estimator capable of computing a concatenation cost of the candidate unit sequence;

a joint cost computation mechanism capable of combining the linguistic prosody cost, the context cost, the mismatch cost, and the concatenation cost to generate the joint cost associated with the candidate unit sequence; and a unit sequence selection mechanism capable of determining a selected unit sequence from the candidate unit sequences that best matches with the target unit sequence and the linguistic target based on the joint cost.

27. An article comprising a storage medium having stored thereon instructions that, when executed by a machine, result in the following:

generating at least one linguistic prosodic model, each of the at least one linguistic prosodic model characterizing a corresponding linguistic prosody and being used to facilitate unit selection during text to speech processing, wherein the at least one linguistic prosodic model is generated from the speech from a target speaker;

receiving an input text for text to speech processing;

generating, according to the input text, a target unit sequence and a linguistic target which annotates the target units in the target unit sequence with a plurality of linguistic prosodic characteristics so that the speech synthesized in accordance with the target unit sequence and the linguistic target has certain desired prosodic properties; and producing synthesized speech using a selected unit sequence determined in accordance with the target unit sequence and the linguistic target based on an estimated joint cost wherein estimating the joint cost comprises computing a linguistic prosody cost based on the at least one linguistic prosodic model, computing a context cost based on at least one context cost function, computing a mismatch cost based on a syllable mismatch matrix with elements defining costs associated with different types of syllable mismatch, a phrase position mismatch matrix with elements defining costs associated with different types of phrase position mismatch, and a stress/pitch accent mismatch matrix with elements defining costs associated with different types of stress/pitch accent mismatch, computing a concatenation cost; and combining the linguistic prosody cost, the context cost, the mismatch cost, and the concatenation cost to generate the joint cost.

28. The article according to claim 27, wherein the at least one model includes at least one of:

a distribution in a feature space;

a function represented by one or more parameters; and a decision tree.

29. The article according to claim 28, wherein the function includes a statistical function.

30. The article according to claim 29, wherein the statistical function includes a Gaussian function.

31. The article according to claim 27, wherein said generating at least one linguistic prosodic model comprises:

generating labeled training data, wherein each training sample in the labeled training data is labeled with at least one linguistic prosody;

identifying a portion of the labeled training data with at least one training sample that has a label corresponding to a distinct linguistic prosody to be modeled;

extracting at least one acoustic feature from each training sample within the portion of the labeled training data; and determining one or more parameters of a linguistic prosodic model based on the at least one acoustic feature, wherein the one or more parameters represent the linguistic prosodic model that characterizes the distinct linguistic prosody.

32. The article according to claim 27, wherein said producing synthesized speech comprises:

receiving the target unit sequence with the linguistic target;

identifying one or more candidate unit sequences, each of which comprises a plurality of units selected in accordance with the target unit sequence and the linguistic target;

estimating a joint cost for each of the candidate unit sequences using the at least one linguistic prosodic model;

selecting one of the candidate unit sequences as the selected unit sequence that has a minimum joint cost; and synthesizing the speech using the selected unit sequence.

33. The article according to claim 27, wherein the joint cost is computed as an linear combination of the linguistic prosody cost, the context cost, the mismatch cost, and the concatenation cost.

34. The article according to claim 27, comprising a storage medium having stored thereon instructions for generating a linguistic prosodic model for text to speech processing that, when executed by a machine, result in the following:

generating labeled training data, wherein each training sample in the labeled training data is from a target speaker and is labeled with at least one linguistic prosody;

identifying a portion of the labeled training data with at least one training sample that has a label corresponding to a distinct linguistic prosody to be modeled;

extracting at least one acoustic feature from each training sample of the portion of the labeled training data; and determining one or more parameters of a linguistic prosodic model based on the at least one acoustic feature, wherein the one or more parameters represent the linguistic prosodic model that characterizes the distinct linguistic prosody.

35. The article according to claim 34, wherein the linguistic prosodic model includes
at least one of:

a distribution in a feature space;

a function represented by one or more parameters; and a decision tree.

36. The article according to claim 35, wherein the function includes a statistical function.

37. The article according to claim 36, wherein the statistical function includes a Gaussian function.

38. The article according to claim 34, wherein said identifying comprises:

training a decision tree using the labeled training data, wherein leaf nodes of the decision tree correspond to different portions of the labeled training data;

selecting one loaf node in the decision tree that corresponds to the distinct linguistic prosody to be modeled.

39. The article according to claim 34, wherein said identifying comprises determining the portion of the labeled training data based on a label representing the distinct linguistic prosody to be modeled.

40. An article comprising a storage medium having stored thereon instructions for unit selection using at least one linguistic prosodic model that, when executed by a machine, result in the following:

receiving a target unit sequence with a linguistic target, wherein the linguistic target annotates the target units in the target unit sequence with a plurality of linguistic prosodic characteristics so that the speech synthesized in accordance with the target unit sequence and the linguistic target has certain desired prosodic properties;

identifying one or more candidate unit sequences, each of which comprises a plurality of units selected in accordance with the target unit sequence and the linguistic target;

estimating a joint cost associated with each of the candidate unit sequences wherein said estimating the joint cost comprises computing a linguistic prosody cost based on the at least one linguistic prosodic model; computing a context cast based on at least one context cost function; computing a mismatch cost based on a syllable mismatch matrix with elements defining costs associated with different types of syllable mismatch, a phrase position mismatch matrix with elements defining costs associated with different types of phrase position mismatch, and a stress/pitch accent mismatch matrix with elements defining costs associated with different types of stress/pitch accent mismatch; computing a concatenation cost; and combining the linguistic prosody cost, the context cost, the mismatch cost, and the concatenation cost to generate the joint cost; and selecting one of the candidate unit sequences to be a selected unit sequence that has a minimum joint cost.

41. The article according to claim 40, wherein the joint cost is computed as a linear combination of the linguistic prosody cost, the context cost, the mismatch cost, and the concatenation cost.

42. The article according to claim 40, wherein the at least one model includes at least one of:

a distribution in a feature space;

a function represented by one or more parameters; and a decision tree.

43. The article according to claim 42, wherein the function includes a statistical function.

44. The article according to claim 43, wherein the statistical function includes a Gaussian function.

45. The article according to claim 40, wherein the joint cost is computed as a linear combination of the linguistic prosody cost, the context cost, the mismatch cost, and the concatenation cost.

46. The article according to claim 45, wherein the linear combination includes any one of:

a summation; and a weighted sum.

47. The article according to claim 40, wherein the linguistic prosody cost includes at least one of:

a pitch cost;

an energy cost; and a duration cost.

* * * * *